US007661153B2

(12) United States Patent
Nakamura et al.

(10) Patent No.: US 7,661,153 B2
(45) Date of Patent: Feb. 16, 2010

(54) FLUSH TOILET

(75) Inventors: Kenichi Nakamura, Kitakyusyu (JP); Tsuyoshi Ozeki, Kitakyusyu (JP); Toshifumi Yoneda, Kitakyusyu (JP); Tomoyasu Ichiki, Kitakyusyu (JP); Hiroshi Tomonari, Kitakyusyu (JP); Kyoji Asada, Kitakyusyu (JP); Katsuhiro Kawakami, Kitakyusyu (JP)

(73) Assignee: Toto Ltd. (JP)

( * ) Notice: Subject to any disclaimer, the term of this patent is extended or adjusted under 35 U.S.C. 154(b) by 145 days.

(21) Appl. No.: 10/526,337

(22) PCT Filed: Sep. 3, 2003

(86) PCT No.: PCT/JP03/11255

§ 371 (c)(1),
(2), (4) Date: Mar. 2, 2005

(87) PCT Pub. No.: WO2004/022862

PCT Pub. Date: Mar. 18, 2004

(65) Prior Publication Data

US 2006/0005310 A1 Jan. 12, 2006

(30) Foreign Application Priority Data

Sep. 3, 2002 (JP) ..... 2002-258054
Feb. 24, 2003 (JP) ..... 2003-045253

(51) Int. Cl.
*E03D 11/00* (2006.01)

(52) U.S. Cl. ..... 4/420; 4/421; 4/425; 4/428

(58) Field of Classification Search ..... 4/420, 4/421, 425, 428
See application file for complete search history.

(56) References Cited

U.S. PATENT DOCUMENTS

| | | | | | |
|---|---|---|---|---|---|
| 2,158,362 | A * | 5/1939 | Groeniger | ..... | 4/425 |
| 4,930,167 | A * | 6/1990 | Ament | ..... | 4/420 |
| 5,926,863 | A * | 7/1999 | Arita et al. | ..... | 4/425 |
| 6,145,138 | A * | 11/2000 | Nakamura et al. | ..... | 4/425 |
| 7,111,333 | B1 * | 9/2006 | Lo et al. | ..... | 4/420 |
| 2007/0061955 | A1 * | 3/2007 | Asada et al. | ..... | 4/425 |

FOREIGN PATENT DOCUMENTS

| | | |
|---|---|---|
| JP | 55-2135 | 1/1980 |
| JP | 2002-097704 | 5/2002 |
| JP | 05-61272 | 8/2007 |

* cited by examiner

*Primary Examiner*—Khoa D Huynh
(74) *Attorney, Agent, or Firm*—Brooks Kushman P.C.

(57) ABSTRACT

A flush toilet that uses a prescribed amount of cleansing water stored in a cleansing water tank to cleanse the toilet and discharge waste is disclosed. The flush toilet includes a bowl having a waste receiving surface, an overhanging rim and a shelf, a drainage channel whose inlet is connected to the bottom of the bowl for discharging waste, a first water spouting section for spouting cleansing water onto the shelf of the bowl to form a vortex; a second water spouting section for spouting cleansing water onto shelf of the bowl in the same direction as the swirling direction of the vortex, a first water channel for supplying cleansing water from the cleansing water tank to the first water spouting section, and a second water channel for supplying cleansing water from the cleansing water tank to the second water spouting section.

12 Claims, 21 Drawing Sheets

FIG.26

| | | CLEANSING LIMIT (A) | CONVEYANCE LIMIT (B) | EMBODIMENT (C) | PERFORMANCE LIMIT (D) | WATER SPLASHING LIMIT (E) |
|---|---|---|---|---|---|---|
| INVENTION | TANK CAPACITY (6L)<br>AMOUNT OF SPOUTED RIM WATER FROM THE FIRST WATER SPOUT (R1)<br>AMOUNT OF SPOUTED RIM WATER FROM THE SECOND WATER SPOUT (R2)<br>AMOUNT OF SPOUTED JET WATER (Z) | R1:0.3<br>R2:0.2<br>Z1:5.5 | R1:0.6<br>R2:0.4<br>Z1:5.0 | R1:1.1<br>R2:0.9<br>Z1:4.0 | R1:1.9<br>R2:1.1<br>Z1:3.0 | R1:2.3<br>R2:1.2<br>Z1:2.5 |
| | ALLOCATION RATIO (R (= R1 + R2) : Z) | —— | 17%:83% | 33%:67% | 50%:50% | —— |
| PRIOR ART | TANK CAPACITY (6L)<br>AMOUNT OF SPOUTED RIM WATER (R)<br>AMOUNT OF SPOUTED JET WATER (Z) | R1:1.3<br>Z1:4.7 | R1:1.8<br>Z1:4.2 | —— | R1:3.0<br>Z1:3.0 | —— |
| | ALLOCATION RATIO (R : Z) | —— | 30%:70% | —— | 50%:50% | —— |

FLUSH TOILET

TECHNICAL FIELD

The present invention relates to a flush toilet, particularly to a flush toilet that produces a vortex to perform cleansing and discharge of waste.

BACKGROUND ART

The ordinary conventional flush toilet has a rim of rectangular cross-section formed at the upper edge portion. The interior of the rim is used as a water channel and the undersurface of the rim is formed with holes or slits for discharging cleansing water onto the waste receiving surface.

However, this type of flush toilet has a problem in that the boundary region between the rim undersurface and the waste receiving surface is a blind area that cannot be seen from above. Dirty matter is therefore liable to remain at this region, particularly on the rim undersurface, which is not reached by the cleansing water vortex. Moreover, the boundary region sometimes cannot be thoroughly glazed owing to its concealed location. This also leads to adherence of dirty matter.

In order to overcome this problem of the ordinary conventional flush toilet of this type, the assignee previously developed a new flush toilet structure that does not use the interior of the rim as a water channel. This structure is described in WO98/16696 (Ref. No. 1).

In this flush toilet, the inner surface of the rim facing the bowl and the waste receiving surface are made continuously smooth so as not to form a blind area and cleansing water is supplied to the bowl from a single water spout provided at the rear of the bowl. The cleansing water is jetted from the water spout in the vicinity of the boundary region between rim and the waste receiving surface to form a vortex that carries the cleansing water over the entire waste receiving surface.

In the flush toilet of Ref. No. 1, the rim inner surface is given an overhang configuration to prevent cleansing water from overflowing to the outside of the toilet bowl. Consideration is also given to the fact that causing the cleansing water to complete a full circle is not practical because the long distance involved would necessitate a high water discharge pressure. In addition, the need to spread the cleansing water uniformly throughout would restrict freedom of shape selection. The proposed structure therefore calls for the provision of left and right facing water spouts at the rear of the bowl so that cleansing water from the water source can be supplied dividedly to the left and right water spouts.

Japanese Patent Laid-Open Publication No. 9-125502 (Ref. No. 2) teaches a flush toilet in which a distributor is installed at the bottom of a low tank and bubbly water (cleansing water) is dividedly supplied to the bowl in opposite lateral directions.

In addition, Japanese Patent Laid-Open Publication No. 2000-96689 (Ref No. 3) teaches a flush toilet equipped with multiple water spouts used to form a single vortex. Specifically, water spouts are provided at two locations at the front and rear ends of the bowl and at four locations midway between the front and rear ends of the bowl on either lateral side.

A flush toilet using a cleansing water tank unavoidably experiences a decline in waterhead during supply of cleansing water from the tank to the toilet because the amount of water in the tank decreases as flushing proceeds. When an attempt is made to secure a vortex sufficient for cleansing by increasing the waterhead, the amount of water discharged from the individual water spouts at the start of flushing increases to the point that the cleansing water is liable to spew out of the bowl. Moreover, cleansing of the bowl is liable to be inadequate because at the final stage of flushing the cleansing water vortex does not reach the extremities sufficiently.

In a direct-connection flush toilet, i.e., a toilet supplied with cleansing water directly from a service water pipe, variation in the amount of water supplied during flushing can be reduced when the toilet is flushed by a cleansing water vortex because the flow of cleansing water from the service water pipe is made constant by a constant flow valve or the like. When the pressure of the service water supplied to the water spout(s) is low, however, the cleansing water vortex becomes insufficient to make thorough flushing of the toilet impossible.

Although this problem can be solved by providing a plurality of water spouts, the structures taught by Ref. No. 1 and Ref No. 2 of using a distributor or the like to spout water in opposite lateral directions is disadvantageous in the point that the two oppositely directed vortices collide at the center region of the toilet bowl to cause splashing and also in the point that a smooth siphon effect is inhibited.

Although Ref No. 3 teaches a structure that uses multiple water spouts to form a vortex in a single direction, mere provision of multiple water spouts does not enable the flushing that the bowl (bowl surface) of a flush toilet requires to convey and discharge waste efficiently. Namely, it involves problems from the practical aspect in that it makes no suggestion whatsoever regarding specific structural features for achieving these requirements, such as the location of the water spouts and method of supplying cleansing water to the water spouts.

On the other hand, water-conserving type flush toilets with a tank capacity of 6 to 8 liters have been moving into a position of dominance in recent years. Since the amount of cleansing water supplied is less than that from the conventional tank, waste must be discharged by producing a siphon effect shortly after the start of water supply. If the siphon effect should come into action later, the waste discharge performance will decrease in proportion to the delay. The siphon jet system that supplies cleansing water directly from jet holes on opposite sides of the mouth of the discharge passage is preferably adopted in order to ensure production of a siphoning action at an early stage. In the case of the siphon jet flush toilet, however, a larger amount of water has to be supplied to the jet holes than to the water spouts that form the vortex. As a result, cleansing of the bowl (surface) becomes insufficient because not enough water is supplied to the water spouts, thus posing a fundamental problem. From the foregoing it will be understood that bowl surface cleansing performance and waste discharge performance are both very basic requirements that must be met in a flush toilet. A flush toilet equipped with a water-conserving tank that can overcome the foregoing problems is therefore strongly desired.

DISCLOSURE OF INVENTION

It is therefore an object of the present invention to provide a flush toilet that by producing a vortex of cleansing water that extends thoroughly to reach the extremities can achieve efficient bowl cleansing and waste discharge, irrespective of whether utilizing a tank or connected directly to a service water pipe.

Another object of the present invention is to provide a flush toilet that is excellent in both cleansing performance and waste discharge performance even when equipped with a water-conserving tank.

In a first aspect, the present invention achieves these objects by providing a flush toilet that uses a prescribed amount of cleansing water stored in a cleansing water tank to cleanse the toilet and discharge waste, the flush toilet comprising: a bowl having a bowl-shaped waste receiving surface, a rim constituting an upper edge portion whose inner surface overhangs inward and a shelf formed between the rim and the waste receiving surface; a drainage channel whose inlet is connected to the bottom of the bowl for discharging waste; a first water spouting section for spouting cleansing water onto the shelf of the bowl to form a vortex; a second water spouting section for spouting cleansing water onto shelf of the bowl in the same direction as the swirling direction of the vortex; a first water channel for supplying cleansing water from the cleansing water tank to the first water spouting section; and a second water channel for supplying cleansing water from the cleansing water tank to the second water spouting section.

Since the inner surface of the rim is formed to overhang inward in the structure according to this aspect of the present invention, the blind area present in the conventional structure is not formed, so that the toilet becomes easier to clean and the toilet can be constantly maintained in a sanitary condition.

Owing to the provision of two water spouting sections, the swirl distance of the cleansing water spouted from each water spouting section becomes short to promote cleansing, so that the vortex of cleansing water can extend thoroughly to reach the extremities and thoroughly cleanse the bowl (bowl surface) even if the tank waterhead is low. The first water spouting section and second water spouting section spout cleansing water onto the shelf of the bowl to form a single vortex. A vortex is therefore formed in the direction of the drainage channel inlet that better gathers waste in the bowl than in the case of forming two vortices, whereby the waste can be effectively carried to the drainage channel to be more efficiently discharged out of the toilet.

In the flush toilet according to this aspect of the present invention, the second water channel preferably makes a U-turn to communicate with the second water spouting section.

In this embodiment of the invention flush toilet, the second water channel makes a U-turn inside the rim to communicate with the second water spouting section. The second water channel that supplies cleansing water to the second water spouting section is therefore not required to pass around the interior of the rim over a long distance, so that frictional resistance is lowered to reduce energy loss.

The flush toilet according to this aspect of the present invention preferably further comprises a jet hole section arranged to spout water toward the inlet of the drainage channel.

This embodiment of the invention toilet enables use of a water-conserving tank because a siphoning action can be produced at an early stage by spouting water from the jet hole section toward the inlet of the drainage channel.

In a preferred embodiment of the flush toilet according to this aspect of the present invention, the first water spouting section is installed on one side of the bowl relative to its fore-aft center axis at a point near a point where the radius of curvature of the bowl changes from a smaller value to a larger value and the second water spouting section is installed on the other side of the bowl at a point near a point where the radius of curvature of the bowl changes from a larger value to a smaller value.

Ordinarily, a toilet bowl has a generally elliptical shape with regions of smaller radius of curvature at the front and back and regions of larger radius of curvature on the opposite lateral sides as viewed from above. In the present invention, the first water spouting section is installed on one side of the bowl at a point near the point at the center of the bowl in the fore-aft direction where the radius of curvature of the bowl changes from a smaller value to a larger value and the second water spouting section is installed on the other side of the bowl at a point near the point where the radius of curvature of the bowl changes from a larger value to a smaller value. As a result, the region of larger radius of curvature on one side of the bowl (e.g., the left side as viewed from the front), the region of smaller radius of curvature at the front end and the region of larger radius of curvature on the other side (e.g., the right side as viewed from the front) are washed by cleansing water spouted from the first water spouting section, and the remaining region of larger radius of curvature at the rear end is washed by cleansing water spouted from the second water spouting section. The whole area of the bowl can therefore be effectively cleansed.

In the flush toilet according to this aspect of the present invention, the amount of water spouted at the rim from the first water spouting section is preferably greater than the amount of water spouted at the rim from second water spouting section.

In the flush toilet according to this aspect of the present invention, most of the bowl is cleansed by cleansing water spouted from the first water spouting section and the remaining portion is cleansed by cleansing water spouted from the second water spouting section, thereby enabling reliable cleansing of the bowl. Further, the cleansing water spouted from the first water spout readily forms a stream (main stream) from the front end of the bowl toward the drainage channel opening and the formed main stream serves to force waste, particularly floating waste, into the drainage channel.

In the flush toilet according to this aspect of the present invention, the amount of water spouted at the rim from the first water spouting section is preferably 0.6 to 2.3 liters and the amount of water spouted at the rim from the second water spouting section is preferably 0.4 to 1.2 liters.

In the flush toilet according to this aspect of the present invention, water splashing does not occur because neither the first water spouting section nor the second water spouting section spouts an amount of water exceeding 2.3 liters. However, the total amount of water spouted at the rim from the first and second water spouting sections is at least 1.0 liter, so that the cleansing water can be made to reach all portions of the rim circumference.

In the flush toilet according to this aspect of the present invention, the total amount of water spouted at the rim from the first and second water spouting sections is preferably at least 1.0 liter.

In the flush toilet according to this aspect of the present invention, cleansing water can be made to reach all portions of the rim circumference because the total amount of water spouted at the rim from the first and second water spouting sections is at least 1.0 liter.

In the flush toilet according to this aspect of the present invention, the amount of water spouted from the jet hole section is preferably greater than the total amount of water spouted at the rim from the first water spouting section and second water spouting section.

In the flush toilet according to this aspect of the present invention, a siphoning action is produced earlier in proportion as the amount of water spouted from the jet hole section exceeds the total amount of water spouted at the rim from the first water spouting section and second water spouting section. Use of a water-conserving tank is therefore possible.

In the flush toilet according to this aspect of the present invention, when the capacity of the cleansing water tank is 6 liters, the total amount of water spouted at the rim from the first water spouting section and second water spouting section is preferably 1 to 3 liters and the amount of water spouted from the jet hole section is preferably 5 to 3 liters.

In the flush toilet according to this aspect of the present invention, spouting of 3 liters of water from the jet hole section, the amount required to produce a siphon effect, is ensured, and spouting of 1 liter of water at the rim, the amount required for the cleansing water to reach all portions of the rim circumference, is ensured.

In the flush toilet according to this aspect of the present invention, the shelf of the bowl is preferably formed to vary in width in a manner that causes the main stream of the cleansing water spouted the first water spouting section to flow toward the inlet of the drainage channel.

In the flush toilet according to this aspect of the present invention, the fact that the shelf of the bowl is formed to vary in width in a manner that causes the main stream of the cleansing water spouted from the first water spouting section to flow toward the inlet of the drainage channel results in substantially simultaneous supply to the drainage channel of the amount of water spouted from the jet hole section and the larger of the amounts of water (the main stream) spouted at the rim from the first and second water spouting sections, so that waste, particularly waste floating at the surface of the standing water, can be led to the drainage channel.

In the flush toilet according to this aspect of the present invention, the width of the shelf of the bowl is preferably formed wider at regions on opposite lateral sides of the bowl relative to its fore-aft center axis and formed narrower at the front end region of the bowl.

In the flush toilet according to this aspect of the present invention, the main stream of the cleansing water spouted from the first water spouting section can readily be made to flow toward the inlet of the drainage channel by the simple expedient of varying the width of the bowl shelf.

In the flush toilet according to this aspect of the present invention, the shelf of the bowl is sloped downward, the angle of inclination being downward within the range of 0 to 15 degrees.

In a second aspect, the present invention provides a flush toilet that uses cleansing water supplied from a service water pipe to cleanse the toilet and discharge waste, the flush toilet comprising: a bowl having a bowl-shaped waste receiving surface, a rim constituting an upper edge portion whose inner surface overhangs inward and a shelf formed between the rim and the waste receiving surface; a drainage channel whose inlet is connected to the bottom of the bowl for discharging waste; a first water spouting section for spouting cleansing water onto the shelf of the bowl to form a vortex; a second water spouting section for spouting cleansing water onto shelf of the bowl in the same direction as the swirling direction of the vortex; a first water channel for supplying cleansing water from the service water pipe to the first water spouting section; and a second water channel for supplying cleansing water from the service water pipe to the second water spouting section, the second water channel making a U-turn to communicate with the second water spouting section.

Like the flush toilet according to the first aspect of the present invention, the flush toilet of the structure according to this aspect of the present invention also enables easy cleaning so that the toilet can be constantly maintained in a sanitary condition and further enables the vortex of cleansing water to extend thoroughly to reach the extremities even if the pressure of the service water is low.

The flush toilet according to this aspect of the present invention preferably further comprises means for making the flow rate of cleansing water supplied from the service water pipe to the first water channel and second water channel constant.

In the flush toilet according to this aspect of the present invention, fluctuation in water amount during cleansing can be inhibited.

The flush toilet according to this aspect of the present invention preferably further comprises a jet hole section arranged to spout water toward the inlet of the drainage channel and means for controlling the spouting of water from the jet hole section to occur later than or simultaneously with the spouting of water from the first water spouting section and second water spouting section.

In the flush toilet according to this aspect of the present invention, waste adhering to the waste receiving surface is conveyed to the drainage channel side by water spouted from the first water spouting section and second water spouting section, whereafter the waste is reliably discharged by the siphoning action occurring with spouting of water from the jet hole section.

In a third aspect, the present invention provides a flush toilet that uses cleansing water stored in a cleansing water tank and cleansing water supplied from a service water pipe to cleanse the toilet and discharge waste, the flush toilet comprising: a bowl having a bowl-shaped waste receiving surface, a rim constituting an upper edge portion whose inner surface overhangs inward and a shelf formed between the rim and the waste receiving surface; a drainage channel whose inlet is connected to the bottom of the bowl for discharging waste; a jet hole section arranged to spout cleansing water supplied from the cleansing water tank toward the inlet of the drainage channel; a first water spouting section for spouting cleansing water supplied from the service water pipe onto the shelf of the bowl to form a vortex; a second water spouting section for spouting cleansing water supplied from the service water pipe onto shelf of the bowl in the same direction as the swirling direction of the vortex; a first water channel for supplying cleansing water from the service water pipe to the first water spouting section; and a second water channel for supplying cleansing water from the service water pipe to the second water spouting section.

This aspect of the present invention provides a hybrid flush toilet in which the first and second water spouting sections are supplied with cleansing water from a service water pipe and the jet hole section is supplied with cleansing water from a cleansing water tank. Like the flush toilets according to the first and second aspects of the present invention, the flush toilet of the structure according to this aspect of the present invention also enables easy cleaning so that the toilet can be constantly maintained in a sanitary condition and further enables the vortex of cleansing water to extend thoroughly to reach the extremities, thereby ensuring thorough cleansing of the bowl (bowl surface) even if the pressure of the service water is low. In addition, the first water spouting section and second water spouting section spout cleansing water onto the shelf of the bowl to form a single vortex. A vortex is therefore formed in the direction of the drainage channel inlet that better gathers waste in the bowl to the central region of the vortex than in the case of forming two vortices, whereby the waste can be effectively carried to the drainage channel to be more efficiently discharged out of the toilet.

The flush toilet according to this aspect of the present invention preferably further comprises means for controlling the spouting of water from the jet hole section to occur later than or simultaneously with the spouting of water from the first water spouting section and second water spouting section.

In the flush toilet according to this aspect of the present invention, waste adhering to the waste receiving surface is conveyed to the drainage channel side by water spouted from the first water spouting section and second water spouting section, whereafter the waste is reliably discharged by the siphoning action occurring with spouting of water from the jet hole section.

BRIEF DESCRIPTION OF DRAWINGS

FIG. 26 is a table setting out the cleansing limit A, conveyance limit B, performance limit D etc. of a flush toilet equipped with a cleansing water tank that is an embodiment of the present invention.

BEST MODE FOR CARRYING OUT THE INVENTION

Figure 1:
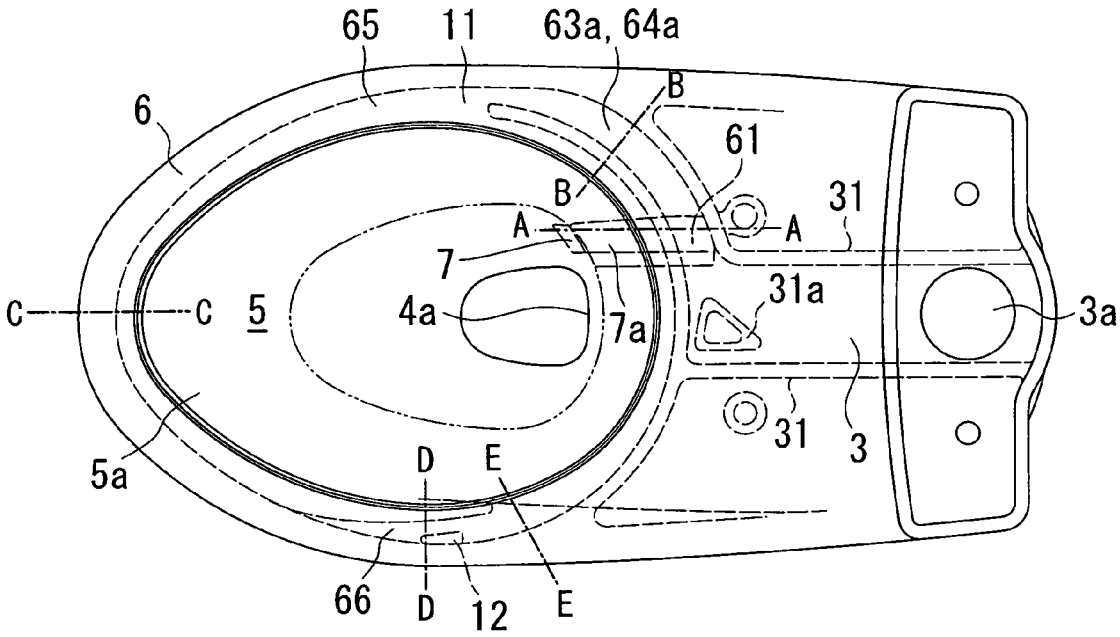
FIG. 1 is a plan view showing a flush toilet that is a first embodiment of the present invention.
Figure 2:
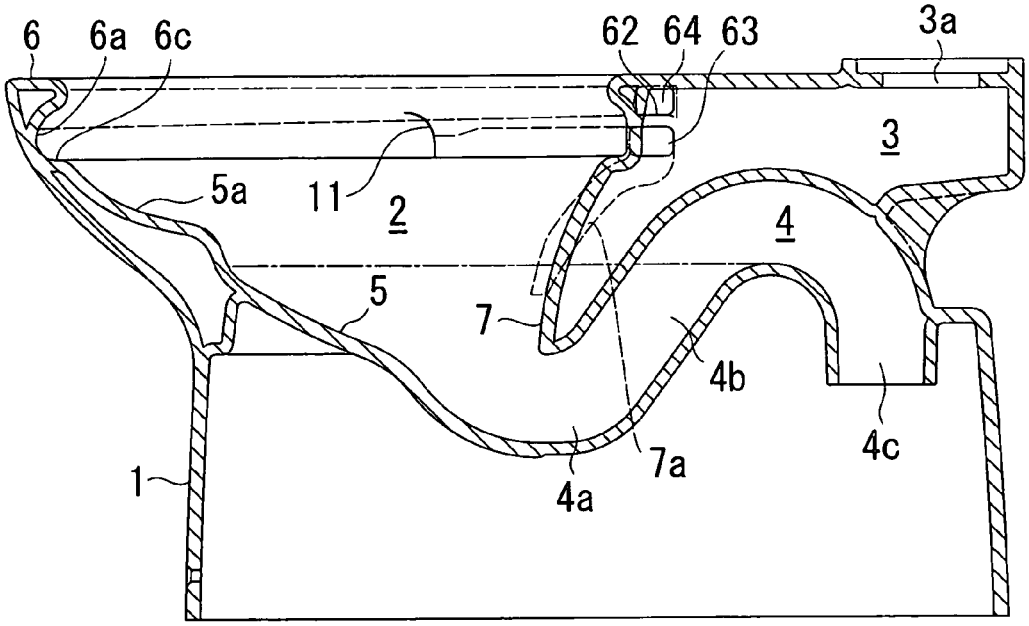
FIG. 2 is a vertical sectional view of the flush toilet shown in FIG. 1.
Figure 3:
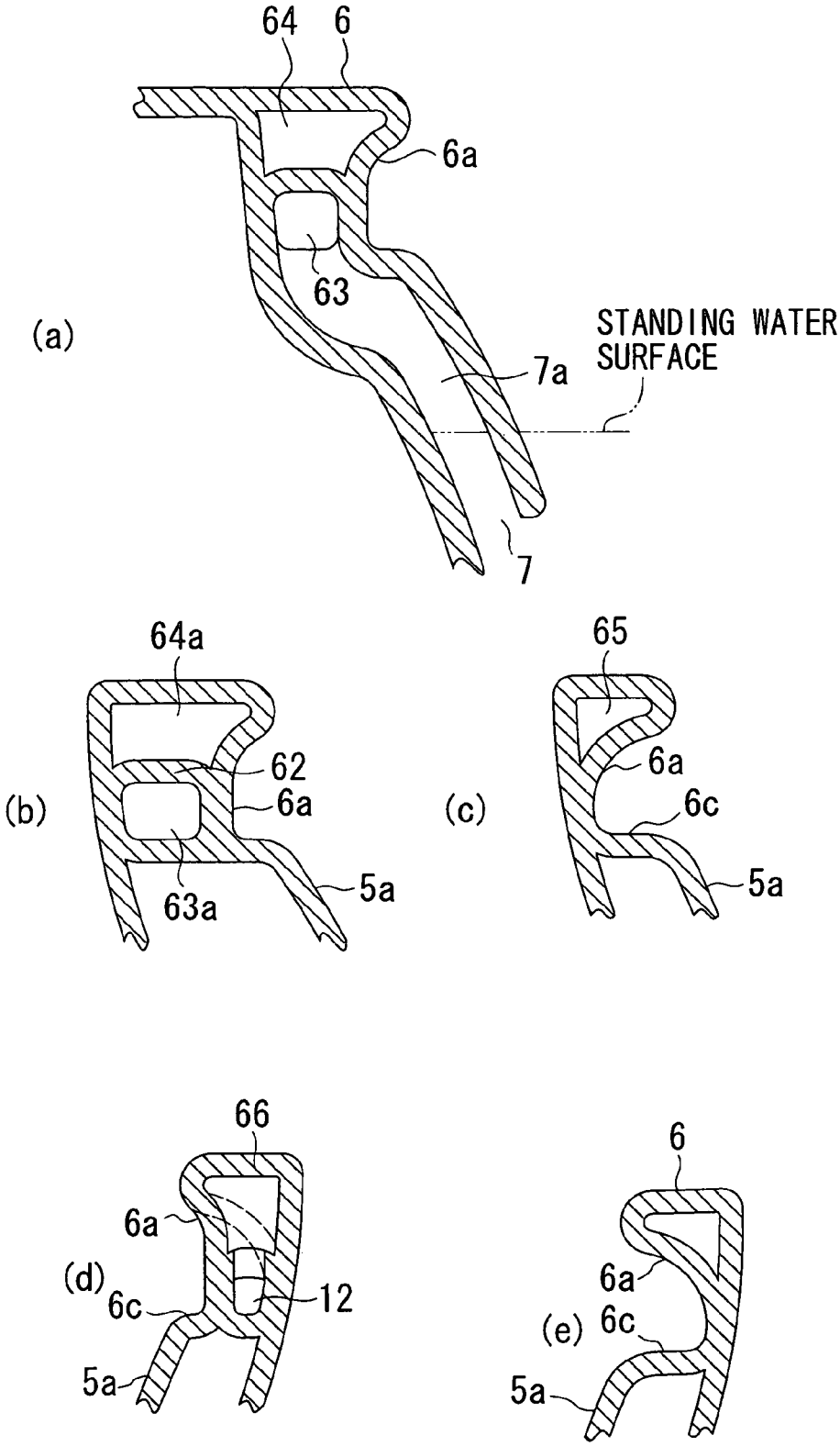
FIG. 3 is a set of drawings in which (a) to (e) are partial sectional views taken along lines A-A to E-E in FIG. 1.

Embodiments of the present invention will now be explained with reference to the attached drawings. A first embodiment of the present invention is shown in FIGS. 1 to 3. FIG. 1 is a plan view showing the flush toilet according to the first embodiment, FIG. 2 is a vertical sectional view of the flush toilet shown in FIG. 1, and FIG. 3 is a set of drawings in which (a) to (e) are partial sectional views taken along lines A-A to E-E in FIG. 1.

The flush toilet shown in FIGS. 1 to 3 is made of glazed porcelain. It has a lower skirt 1 and a bowl 2 at the front of the upper half. The rear of the upper half is formed into a water conduit 3 above and a drainage channel 4 below.

The bowl 2 has a waste receiving surface 5 forming a deep basin and a rim 6 constituting an upper edge portion. The dry surface 5*a* of the waste receiving surface 5, a shelf 6*c* and the inner surface 6*a* of the rim 6 run one into the next along a smooth curved surface. The inner surface 6*a* of the rim 6 is configured to overhang somewhat inwardly in a manner that avoids formation of a blind region, enables the inner surface 6*a* to be easily wiped clean using a piece of disposable paper or the like, and ensures that cleansing water does not splash out of the bowl 2.

The inlet 4*a* of the drainage channel 4 opens near the middle of the waste receiving surface 5 at a location below the surface of water standing in the bowl 2. An ascending passage 4*b* extends rearward from the drainage channel inlet 4*a* to connect with a descending passage 4*c* (vertical pipe) which connects with a sewer pipe through a joint (not shown).

The rear region of the roof of the water conduit 3 is formed with an opening 3*a* closed by a flush valve communicating with a water storage tank or service water pipe. The width of the water conduit 3 is constricted by lateral side walls 31, 31 and a guide member 31*a* is provided near one of the side walls for guiding supplied cleansing water into one side of the rim 6 (left side as viewed from the front of the bowl 2).

The cleansing water diverted by the guide member 31*a* at the front of the water conduit 3 enters rim communicating holes 63, 64 separated vertically by a partition 62 at the front of the associated side wall 31 to advance counterclockwise (cleansing water flow direction) as viewed from above the flush toilet and then flows through water channels 63*a*, 64*a* separated by the partition 62 shown in FIG. 3(*b*). The lower water channel 63*a* communicates with a first water spout 11. The upper water channel 64*a* continues to advance within the rim at the front of the toilet to pass through water channels 65, 66 shown in FIGS. 3(*c*) and 3(*d*) to communicate with a second water spout 12.

On the other hand, cleansing water flowing in through the rim communicating hole 63 passes through a floor opening 61 of the water channel 63*a* which, as shown in FIG. 3(*a*), communicates with water channel 7*a* for supplying cleansing water to a force-flush cleansing water spout 7. The force-flush cleansing water spout 7 opens below the water surface and operates to spout water in the direction of pushing waste into the drainage channel 4.

The first and second water spouts 11, 12 are positioned at heights near the boundary between the dry surface 5*a* of the waste receiving surface 5 and the inner surface 6*a* of the rim 6 and at fore-aft locations sideways of the inlet 4*a* as viewed from above. The first water spout 11 is oriented to spurt cleansing water forward and the second water spout 12 is oriented to spurt cleansing water rearward, so that the cleansing water forms a single vortex that swirls counterclockwise as viewed from above the bowl 2.

In the flush toilet according to this first embodiment, the flow of cleansing water supplied from a water source is divided into two streams by the rim communicating holes 63, 64. Cleansing water flowing in through the rim communicating hole 63 on the one hand passes through the floor opening 61 to be discharged from the force-flush cleansing water spout 7 toward the bowl bottom surface in the vicinity of the inlet 4*a* and on the other hand passes through the water channel 63*a* to be discharged from the first water spout 11. Cleansing water flowing in through the rim communicating hole 64 passes through the water channels 64*a*, 65, 66 to be discharged from the second water spout 12. The cleansing water discharged from the first and second water spouts 11, 12 produces a single vortex that reaches all portions of the waste receiving surface 5.

Figure 4:
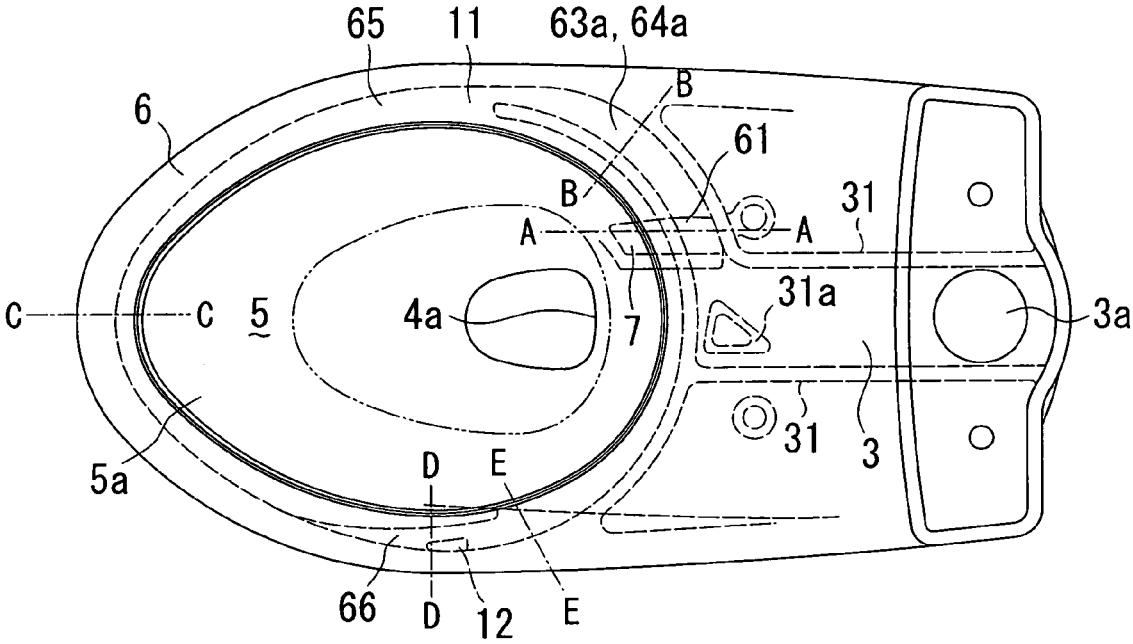
FIG. 4 is plan view showing a flush toilet that is a second embodiment of the present invention.
Figure 5:
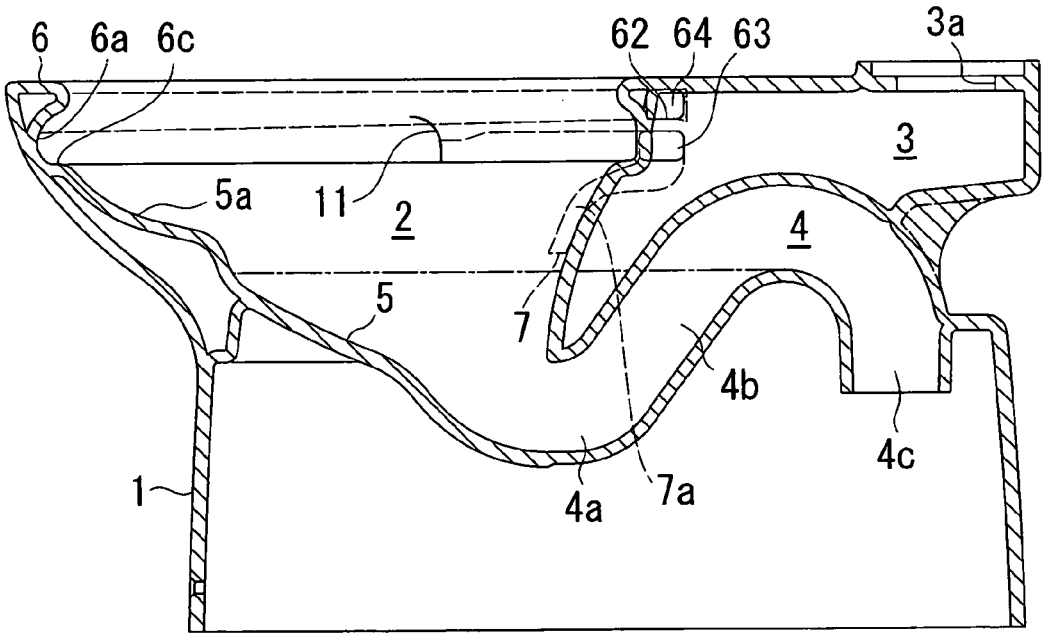
FIG. 5 is a vertical sectional view of the flush toilet shown in FIG. 4.
Figure 6:
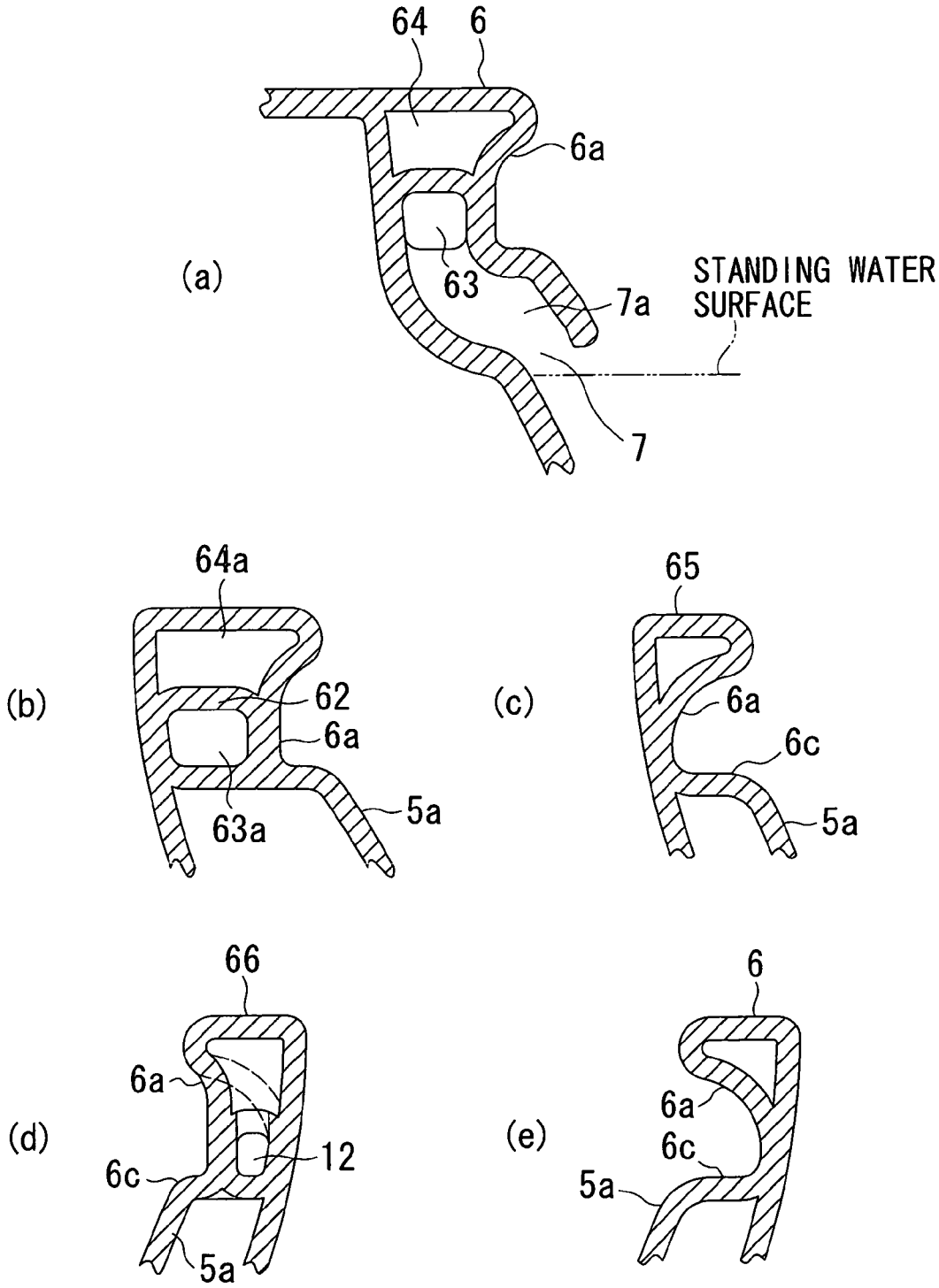
FIG. 6 is a set of drawings in which (a) to (e) are partial sectional views taken along lines A-A to E-E in FIG. 4.

Next, a second embodiment of the present invention will be explained with reference to FIGS. 4 to 6. FIG. 4 is plan view showing a flush toilet that is a second embodiment of the present invention, FIG. 5 is a vertical sectional view of the flush toilet shown in FIG. 4, and FIG. 6 is a set of drawings in which (a) to (e) are partial sectional views taken along lines A-A to E-E in FIG. 4. Portions of the second embodiment like those of the first embodiment are assigned the same symbols as their counterparts in the first embodiment and will not be explained again.

In the flush toilet according to the second embodiment, the force-flush cleansing water spout 7 opens above the surface of the standing water and is adapted to spout cleansing water in the direction of force-flushing waste, particularly waste floating on the standing water surface, into the drainage channel 4.

The water channels 7*a*, 63*a*, 64*a* and the first and second water spouts 11, 12 are structured like those in the first embodiment.

Figure 7:
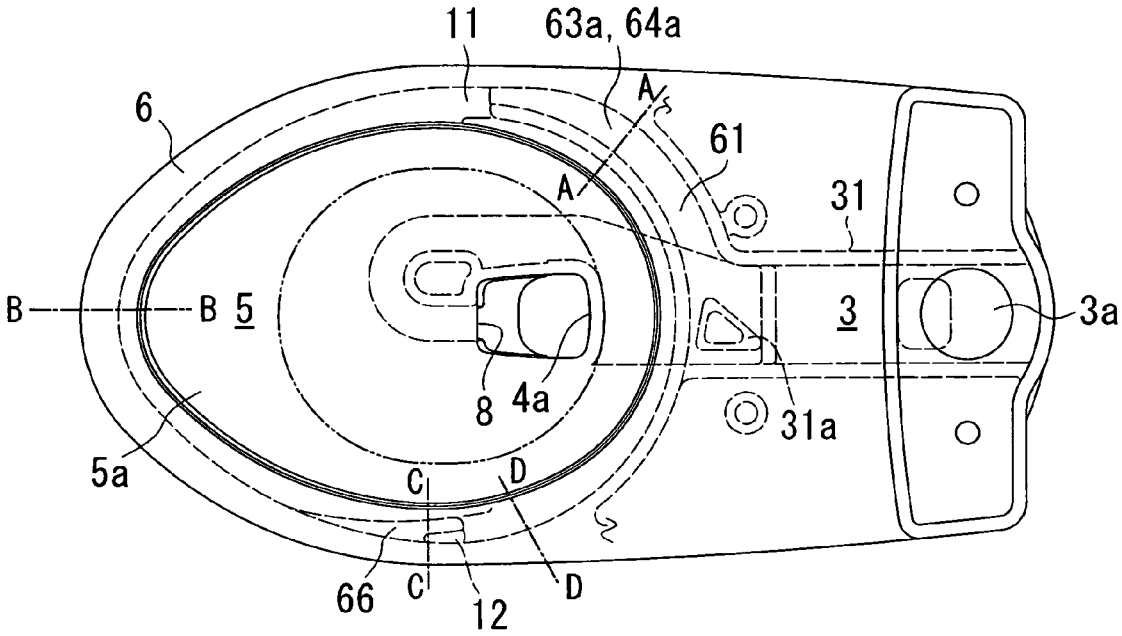
FIG. 7 is plan view showing a flush toilet that is a third embodiment of the present invention.
Figure 8:
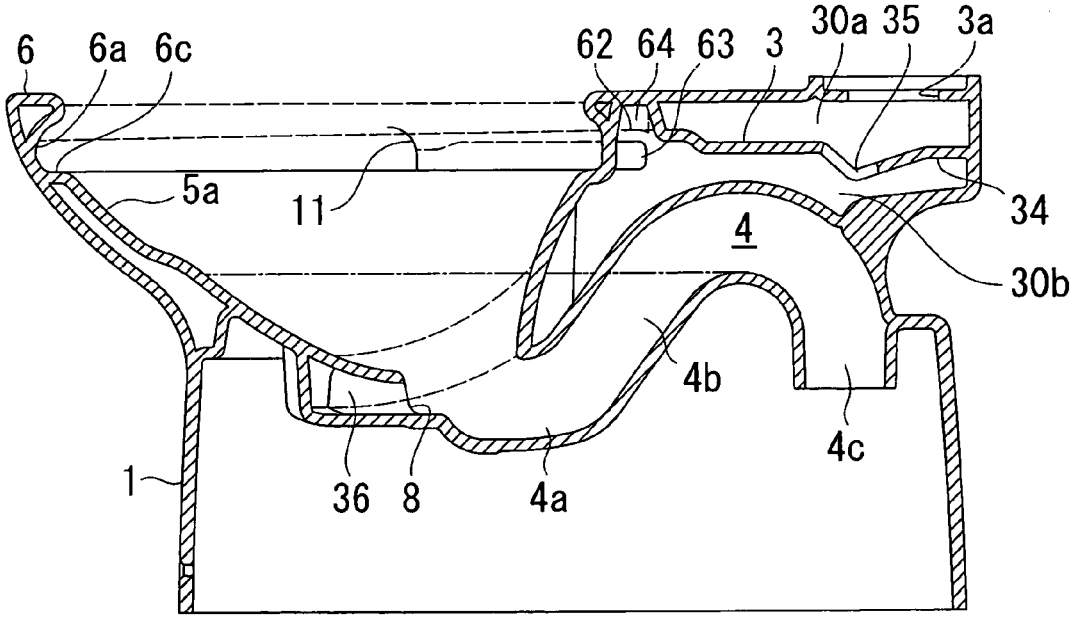
FIG. 8 is a vertical sectional view of the flush toilet shown in FIG. 7.
Figure 9:
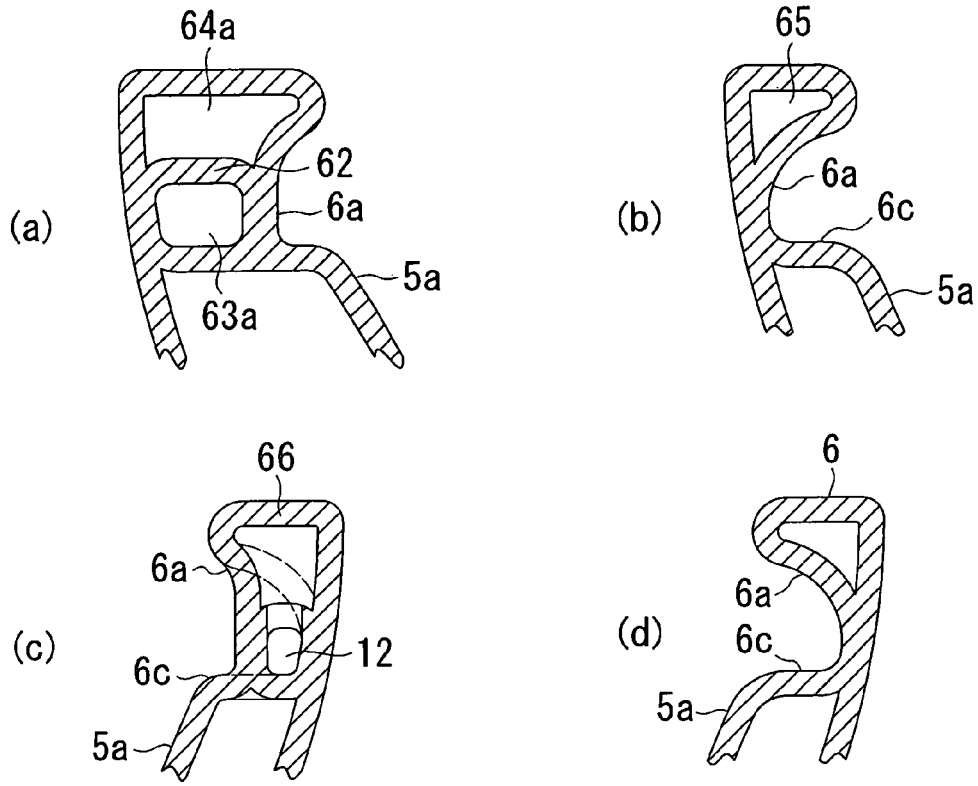
FIG. 9 is a set of drawings in which (a) to (d) are partial sectional views taken along lines A-A to D-D in FIG. 7.

Next, a third embodiment of the present invention will be explained with reference to FIGS. 7 to 9. FIG. 7 is plan view showing a flush toilet that is a third embodiment of the present invention, FIG. 8 is a vertical sectional view of the flush toilet shown in FIG. 7, and FIG. 9 is a set of drawings in which (a) to (d) are partial sectional views taken along lines A-A to D-D in FIG. 7. Portions of the third embodiment like those of the first embodiment are assigned the same symbols as their counterparts in the first embodiment and will not be explained again.

The flush toilet according to the third embodiment is provided at a location opposite the inlet 4*a* with a jet hole 8 for efficiently force-flushing waste into the drainage channel 4.

Moreover, in the third embodiment, the water conduit 3 is divided by a partition 34 into an upper water conduit 30*a* and a lower water conduit 30*b* and cleansing water from the water source is supplied into the lower water conduit 30*b* through an opening 35 formed in the partition 34. The partition 34 prevents delay of siphoning occurrence owing to entrainment of air present in the water conduit into the cleansing water. The upper water conduit 30*a* communicates with the water channel 64*a* for supplying cleansing water to the second water spout 12 and the lower water conduit 30*b* communicates with the water channel 63*a* for supplying cleansing water to the first water spout 11 and with a water channel 36 for supplying cleansing water to the jet hole 8. The cleansing water supplied into the lower water conduit 30*b* passes through the water channel 36 to be discharged from the jet hole 8.

Figure 10:
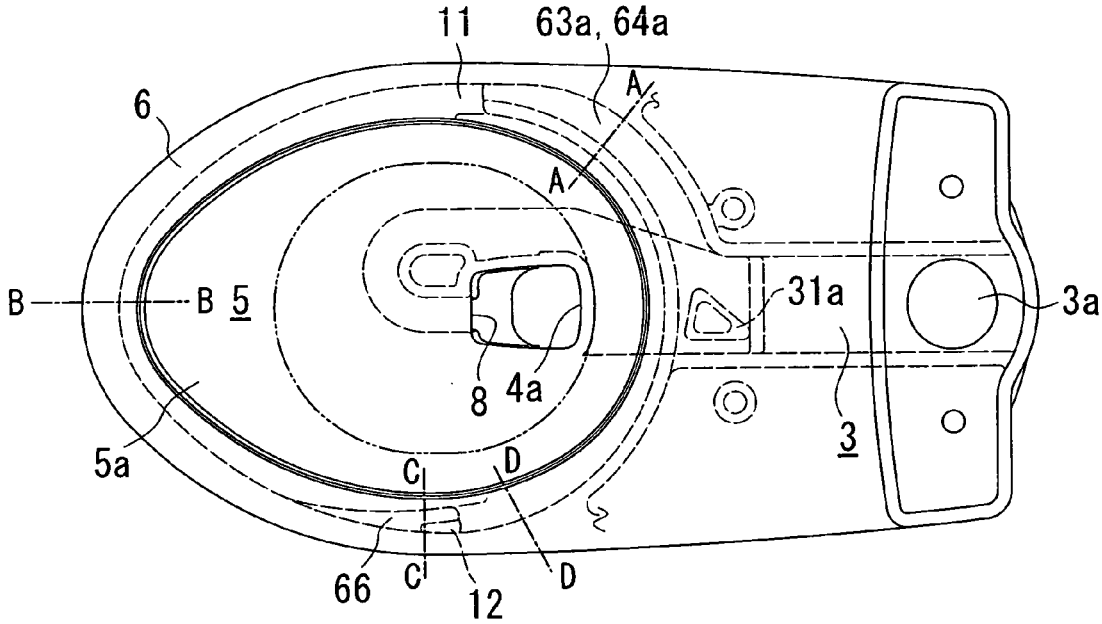
FIG. 10 is plan view showing a flush toilet that is a fourth embodiment of the present invention.
Figure 11:
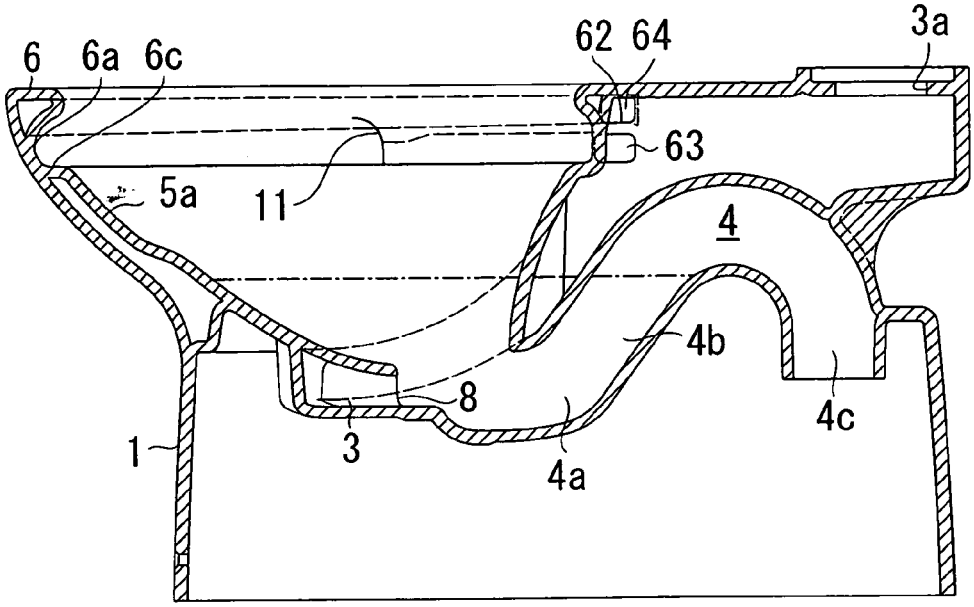
FIG. 11 is a vertical sectional view of the flush toilet shown in FIG. 10.
Figure 12:
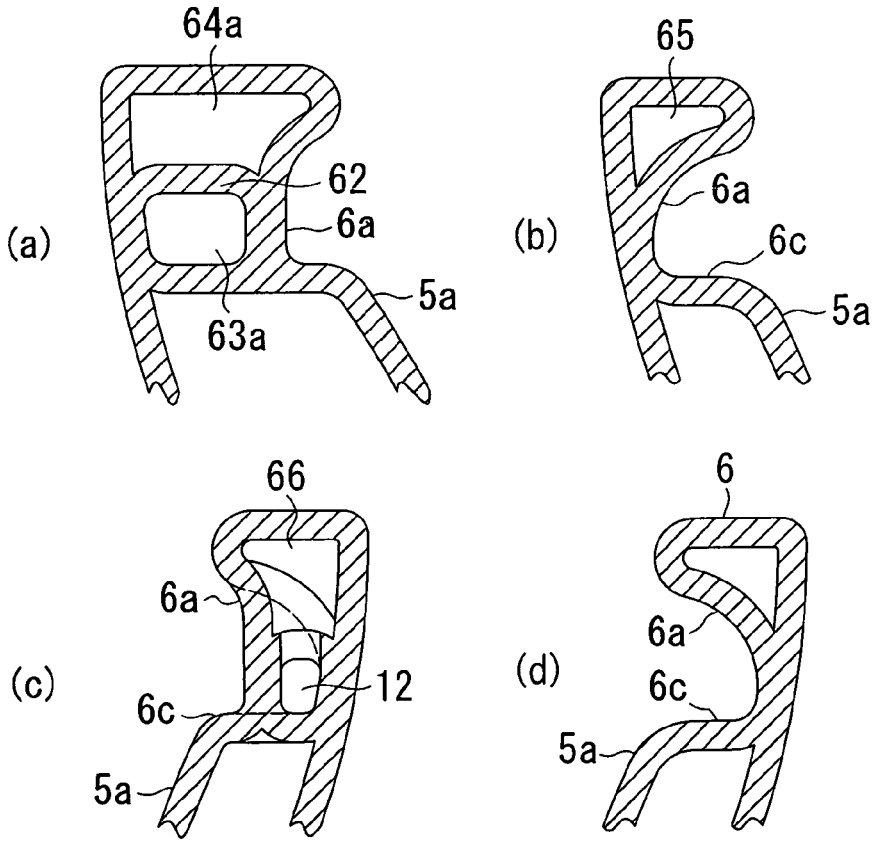
FIG. 12 is a set of drawings in which (a) to (d) are partial sectional views taken along lines A-A to D-D in FIG. 10.

Next, a fourth embodiment of the present invention will be explained with reference to FIGS. 10 to 12. FIG. 10 is plan view showing a flush toilet that is a fourth embodiment of the present invention, FIG. 11 is a vertical sectional view of the flush toilet shown in FIG. 10, and FIG. 12 is a set of drawings in which (a) to (d) are partial sectional views taken along lines A-A to D-D in FIG. 10. Portions of the fourth embodiment like those of the third embodiment are assigned the same symbols as their counterparts in the third embodiment and will not be explained again.

In the flush toilet according to the fourth embodiment, as in the flush toilet according to the first embodiment, the water conduit is not divided into upper and lower water conduits and cleansing water is fed into the water channel 36 that supplies cleansing water to the water channels 63*a*, 64*a* and the jet hole 8.

Figure 13:
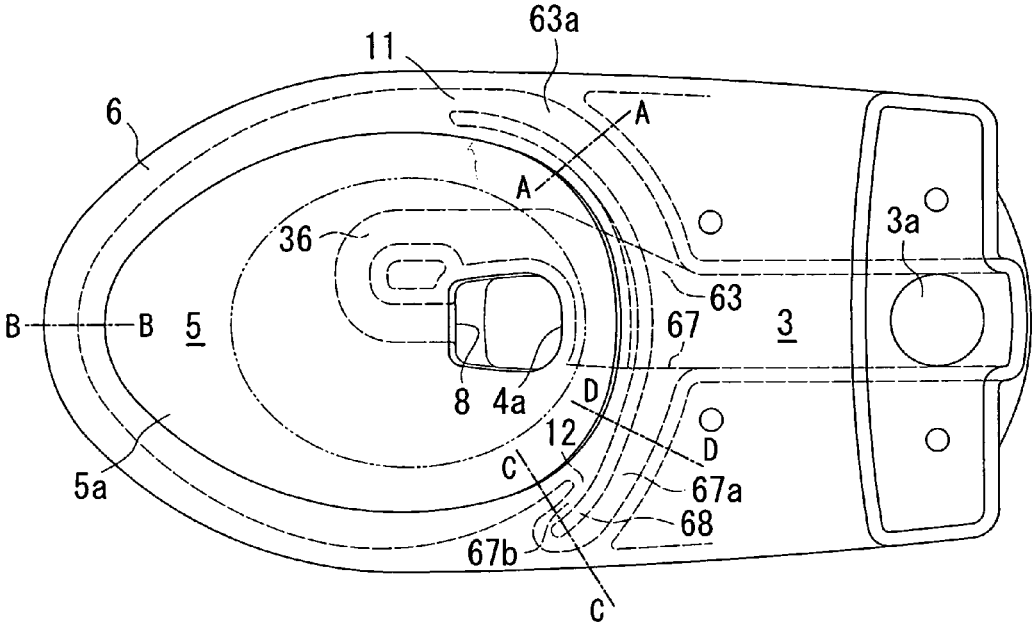
FIG. 13 is plan view showing a flush toilet that is a fifth embodiment of the present invention.
Figure 14:
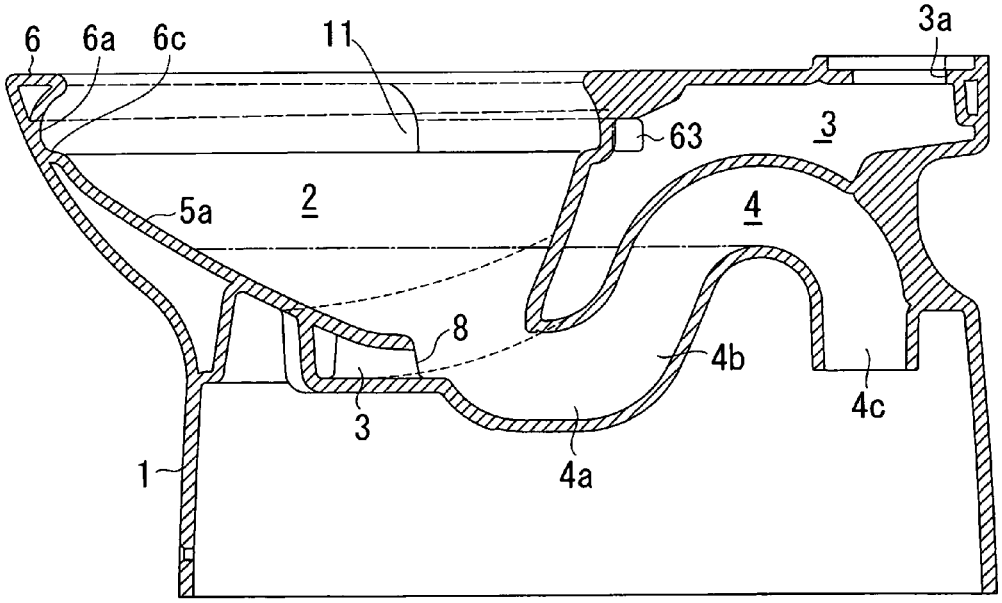
FIG. 14 is a vertical sectional view of the flush toilet shown in FIG. 13.
Figure 15:
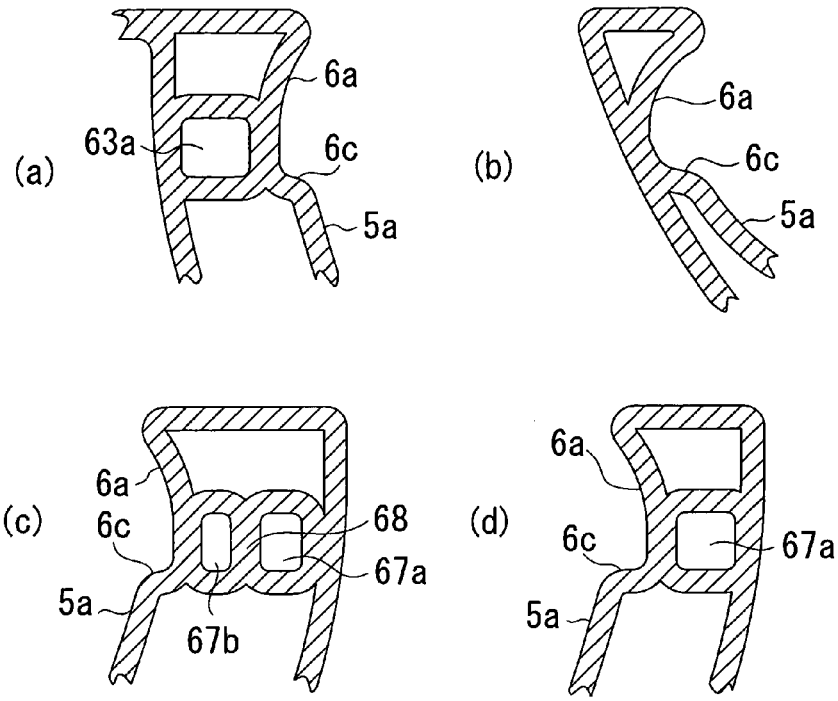
FIG. 15 is a set of drawings in which (a) to (d) are partial sectional views taken along lines A-A to D-D in FIG. 13.

Next, a fifth embodiment of the present invention will be explained with reference to FIGS. 13 to 15. FIG. 13 is plan view showing a flush toilet that is a fifth embodiment of the present invention, FIG. 14 is a vertical sectional view of the flush toilet shown in FIG. 13, and FIG. 15 is a set of drawings in which (a) to (d) are partial sectional views taken along lines A-A to D-D in FIG. 13. Portions of the fifth embodiment like those of the fourth embodiment are assigned the same symbols as their counterparts in the first embodiment and will not be explained again.

In the flush toilet according to the fifth embodiment, part of the cleansing water supplied from the water source is made to branch off into rim communicating holes 63, 67 provided on opposite lateral sides at the front end of the water conduit 3. The water entering the rim communicating hole 63 flows counterclockwise as viewed from above and the water entering the communicating hole 67 advances counterclockwise.

The water entering from the rim communicating hole 63 passes through the water channel 63*a* and is then discharged from the first water spout 11 onto the waste receiving surface 5 counterclockwise as viewed from above. The water entering from the communicating hole 67 passes through a water channel 67*a*, makes a U-turn at the tip of a partition 68, and passes through a water channel 67*b* to be discharged from the second water spout 12 onto the waste receiving surface 5 counterclockwise as viewed from above the flush toilet. This arrangement effectively inhibits dew condensation because it shortens the path traversed by the water inside the rim 6.

In addition, during water conveyance, air present in the water channels 63*a*, 67*a*, 67*b* leading to the first and second water spouts 11, 12 and in the water channel 36 leading to the jet hole 8 is rapidly displaced by the cleansing water and expelled from the first and second water spouts 11, 12, so that no compression of air occurs in the water conduits. This helps to prevent loss of the energy of the cleansing water flow and is advantageous from the viewpoint of reducing flushing noise.

Owing to the simple water channel structure, moreover, the water channels 63*a*, 67*a*, 67*b* can be sloped in the gravitational direction to reduce the small amount of water that is continuously discharged onto the waste receiving surface from the water spouts over a long period after flushing, whereby formation of the streak-like deposits on the waste receiving surface can be reduced.

Figure 16:
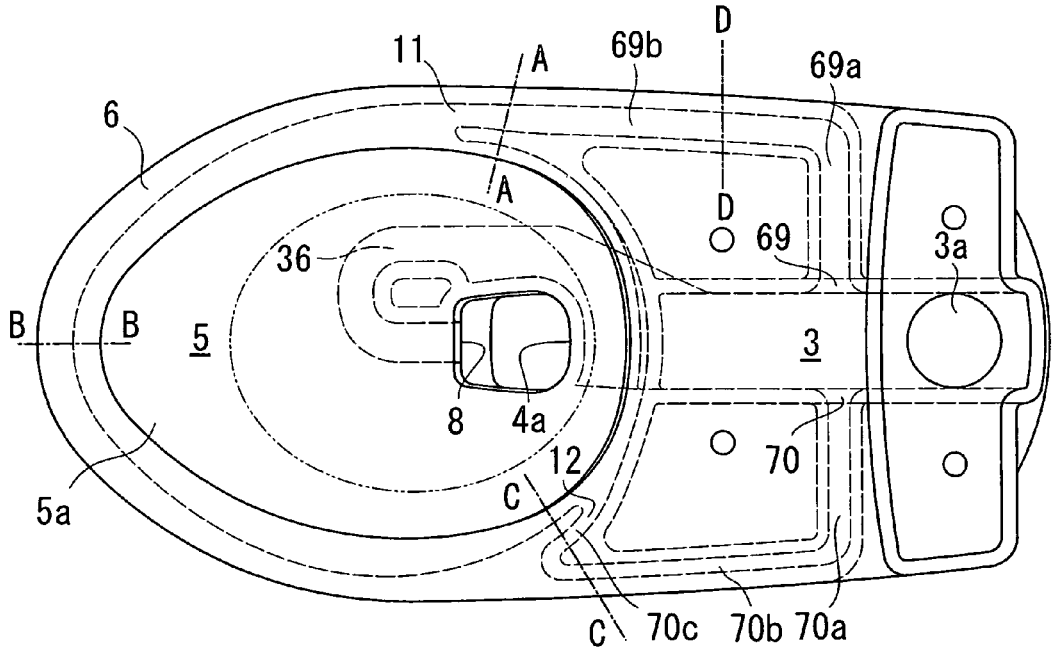
FIG. 16 is a plan view showing a flush toilet that is a sixth embodiment of the present invention.
Figure 17:
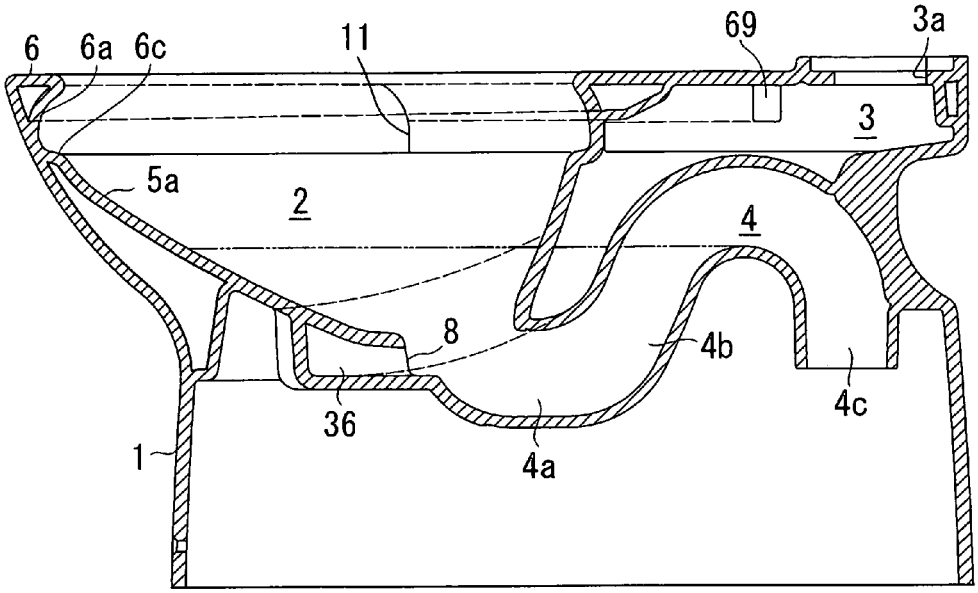
FIG. 17 is a vertical sectional view of the flush toilet shown in FIG. 16.
Figure 18:
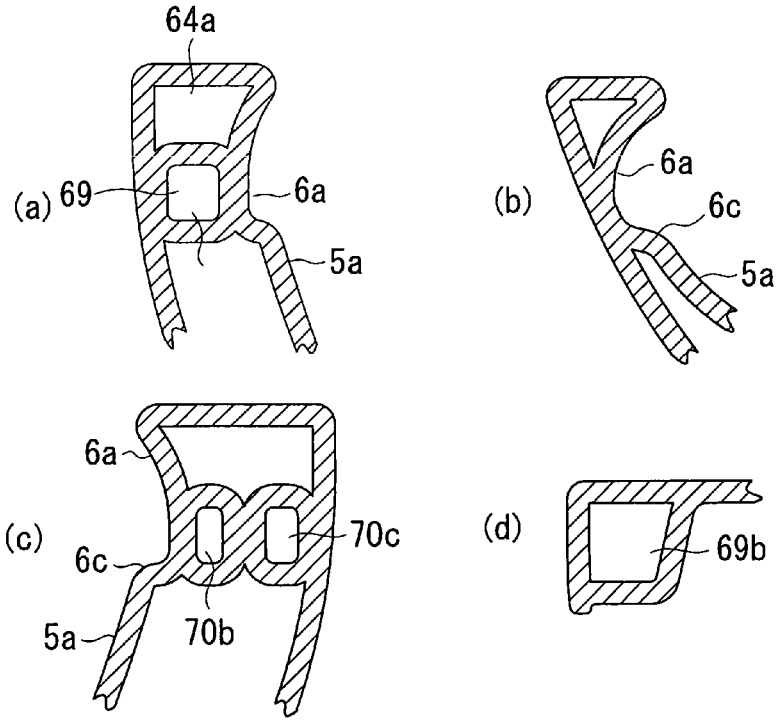
FIG. 18 is a set of drawings in which (a) to (d) are partial sectional views taken along lines A-A to D-D in FIG. 16.

Next, a sixth embodiment of the present invention will be explained with reference to FIGS. 16 to 18. FIG. 16 is plan view showing a flush toilet that is a sixth embodiment of the present invention, FIG. 17 is a vertical sectional view of the flush toilet shown in FIG. 16, and FIG. 18 is a set of drawings in which (a) to (d) are partial sectional views taken along lines A-A to D-D in FIG. 16. Portions of the sixth embodiment like those of the fifth embodiment are assigned the same symbols as their counterparts in the first embodiment and will not be explained again.

In the flush toilet according to the sixth embodiment, rim communicating holes 69, 70 are provided on laterally opposite sides of the water conduit 3 at its upstream end near the opening 3*a* and part of the cleansing water supplied from the water source is made to branch off into the rim communicating holes 69, 70. Water entering through the rim communicating hole 69 passes through water channels 69*a*, 69*b* and is then discharged from the first water spout 11 onto the waste receiving surface 5 counterclockwise as viewed from above the flush toilet.

Water entering through the rim communicating hole 70 passes through water channels 70*a*, 70*b*, 70*c* and is then discharged from the second water spout 12 onto the waste receiving surface 5 counterclockwise as viewed from above the flush toilet.

In this embodiment, also, during water conveyance, air present in the water channels 36, 70*a*, 70*b*, 70*c* is rapidly displaced by the cleansing water and expelled from the first and second water spouts 11, 12, so that no compression of air occurs in the water conduits. This helps to prevent loss of the energy of the cleansing water flow and is advantageous from the viewpoint of reducing flushing noise.

Figure 19:
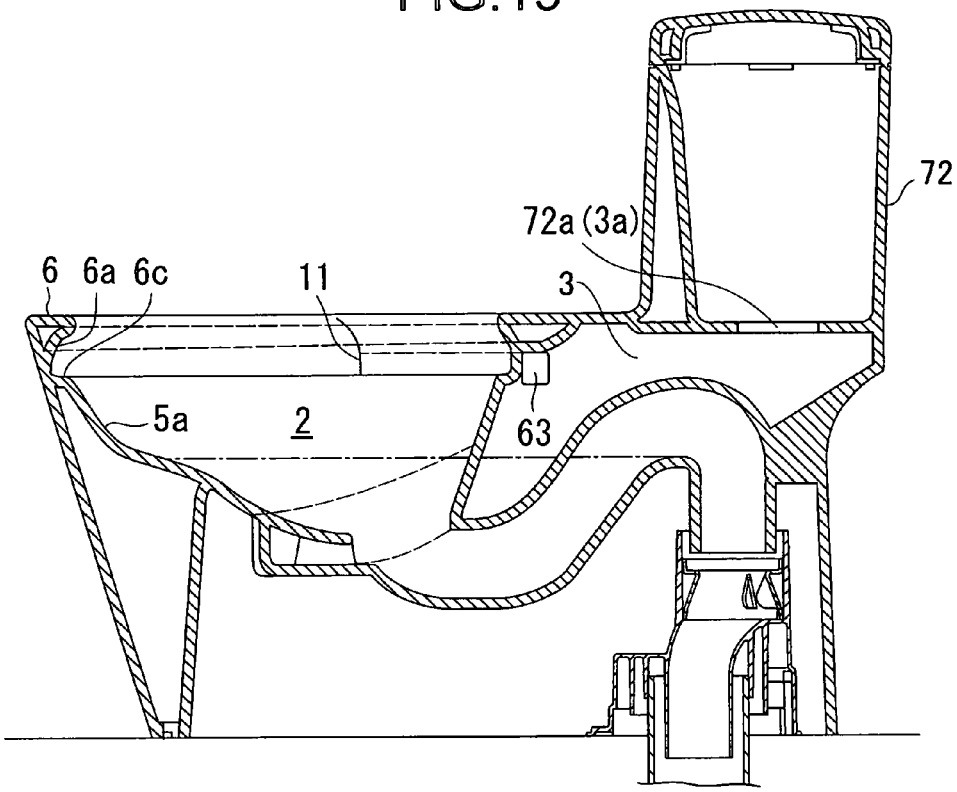
FIG. 19 is a vertical sectional view showing a flush toilet equipped with a cleansing water tank that is a seventh embodiment of the present invention.

Next, a seventh embodiment of the present invention will be explained with reference to FIGS. 19 to 25. FIG. 19 is a vertical sectional view showing a flush toilet equipped with a cleansing water tank that is a seventh embodiment of the present invention, and FIG. 20 is a plan view of the flush toilet shown FIG. 19.

The basic structure of the flush toilet according to the seventh embodiment is the same as that of the flush toilet according to the fifth embodiment explained above (see FIGS. 13 to 15) but differs therefrom in that it is equipped with a water-conserving tank (6 to 8 liters) and that the width and slope of the shelf vary along the flow of the vortex. A specific explanation of these points will now be set out.

Figure 20:
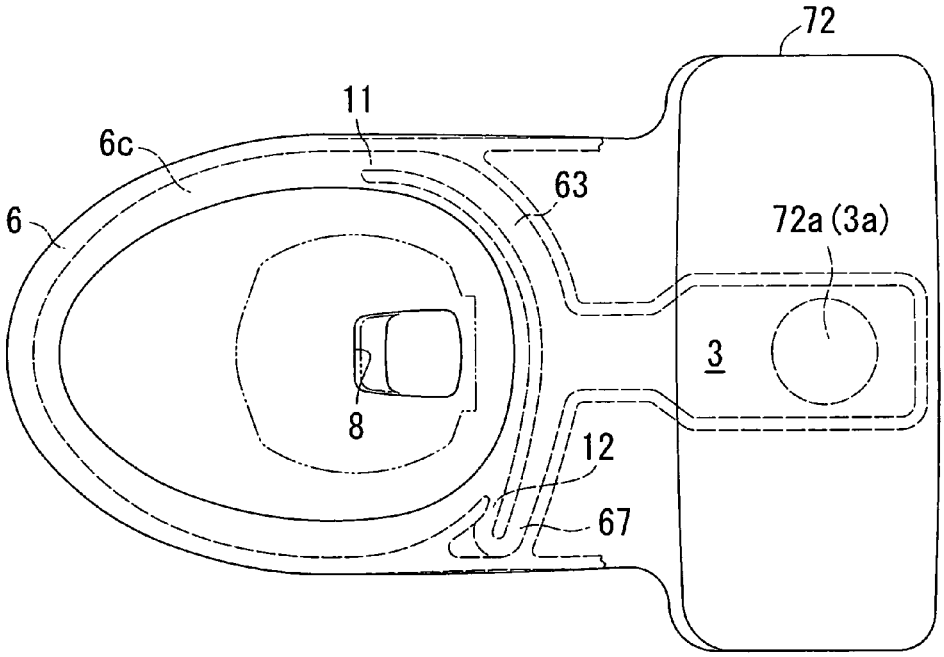
FIG. 20 is a plan view of the flush toilet shown FIG. 19.

As shown in FIGS. 19 and 20, the flush toilet is equipped with a water-conserving tank (6 to 8 liters) 72. The water-conserving tank 72 is what is called a "low-silhouette" flushing water tank. A "low-silhouette" tank generally has low a waterhead. The flush toilet is a "once-piece toilet" having the water-conserving tank 72 integrally formed with the main flush toilet unit. An opening 72*a* formed at the bottom of the water-conserving tank 72 therefore also serves as the opening 3*a* of the water conduit 3.

In this embodiment, the shelf 6*c* of the bowl is defined as a nearly horizontal region of moderate slope compared with the slope of the waste receiving surface 5. It is a path for causing the cleansing water from the first and second water spouts 11, 12 to swirl above the waste receiving surface 5. It is a downwardly sloping region that has a downward angle of inclination θ in the range of 0 degrees to 15 degrees and a shelf width W.

Figure 21:
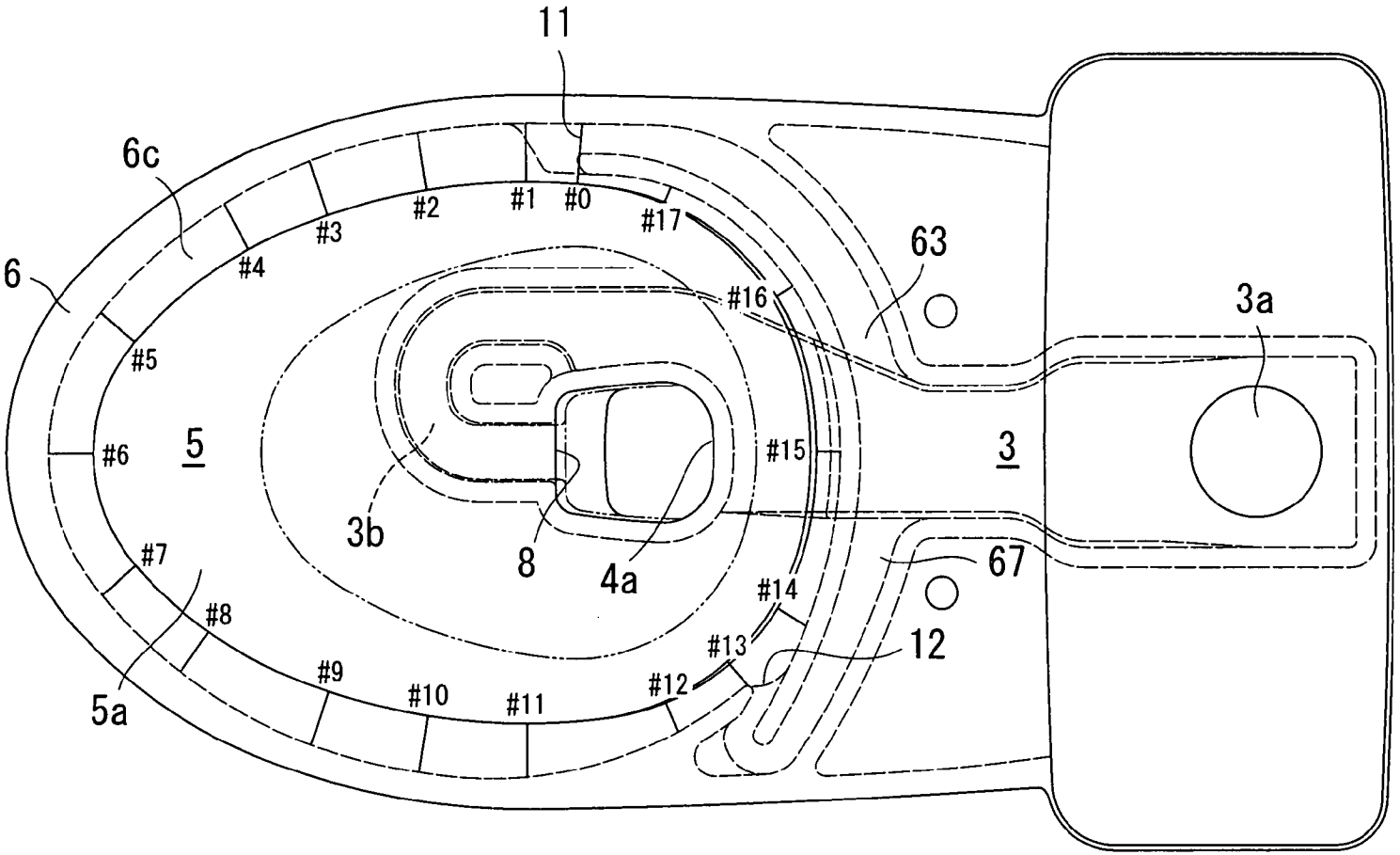
FIG. 21 is a plan view indicating arbitrary locations #0-#17 on the bowl (shelf) of the flush toilet according to the seventh embodiment of the present invention (shown without the tank).
Figure 22:
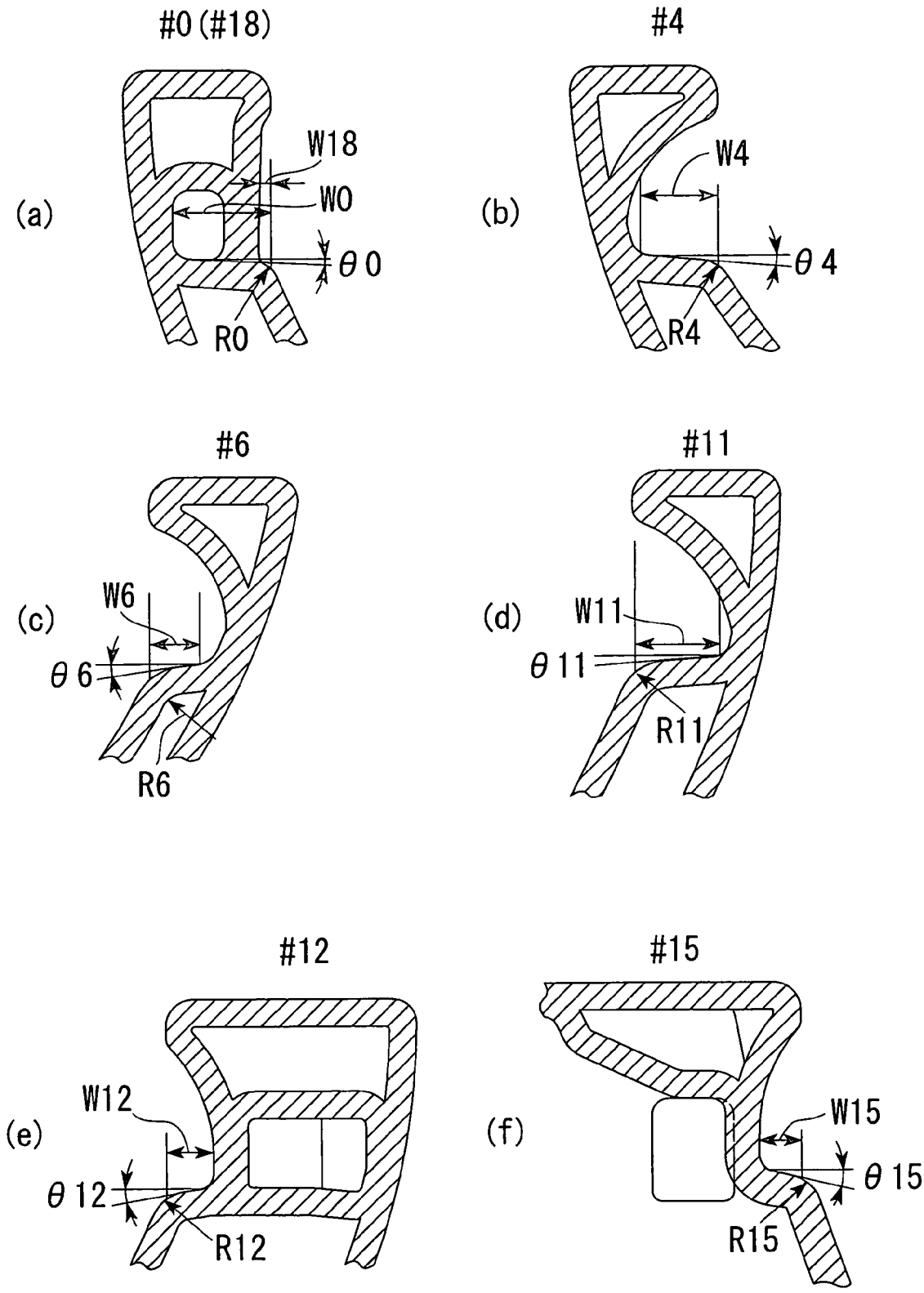
FIG. 22 is a set of drawings in which (a) to (f) are sectional views of portions of the bowl including the shelf taken at some of the arbitrary locations.
Figure 23:
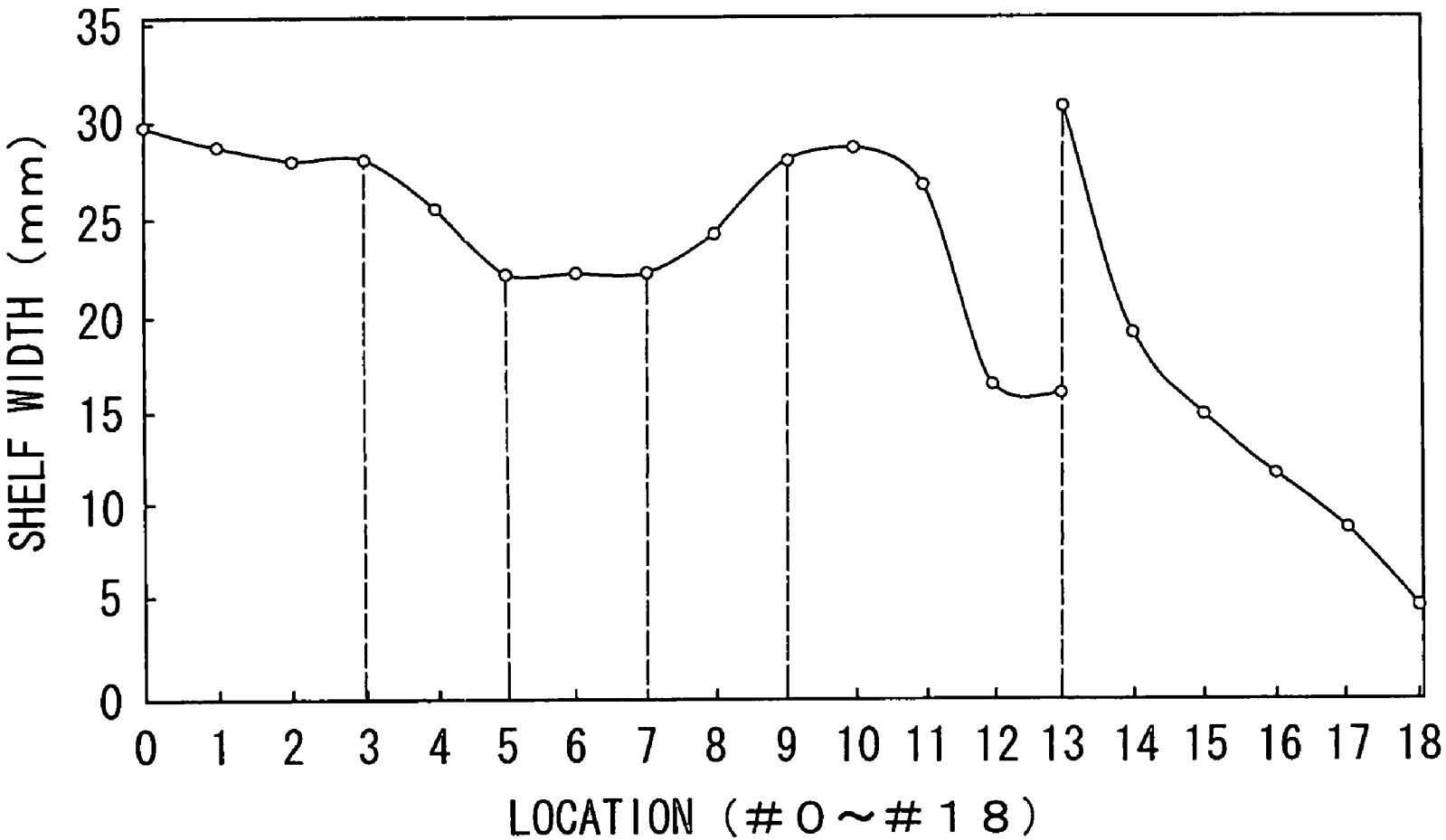
FIG. 23 is a graph showing the width of the shelf (shelf width) at the locations #0-#17 in the flush toilet according to the seventh embodiment of the present invention.
Figure 24:
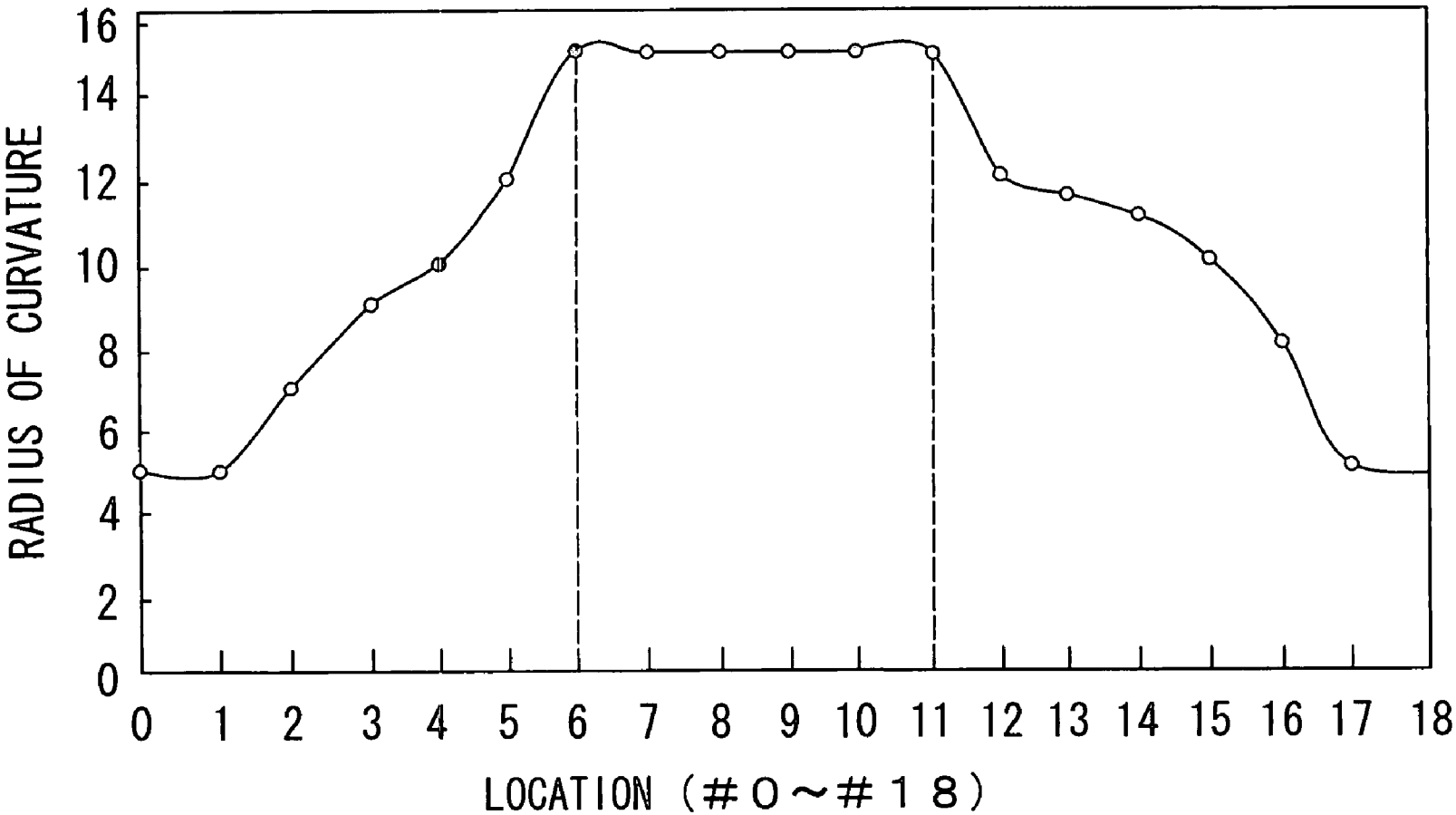
FIG. 24 is a graph showing the radius of curvature of the curved surface between the shelf and waste receiving surface at the locations #0-#17 in the flush toilet according to the seventh embodiment of the present invention.
Figure 25:
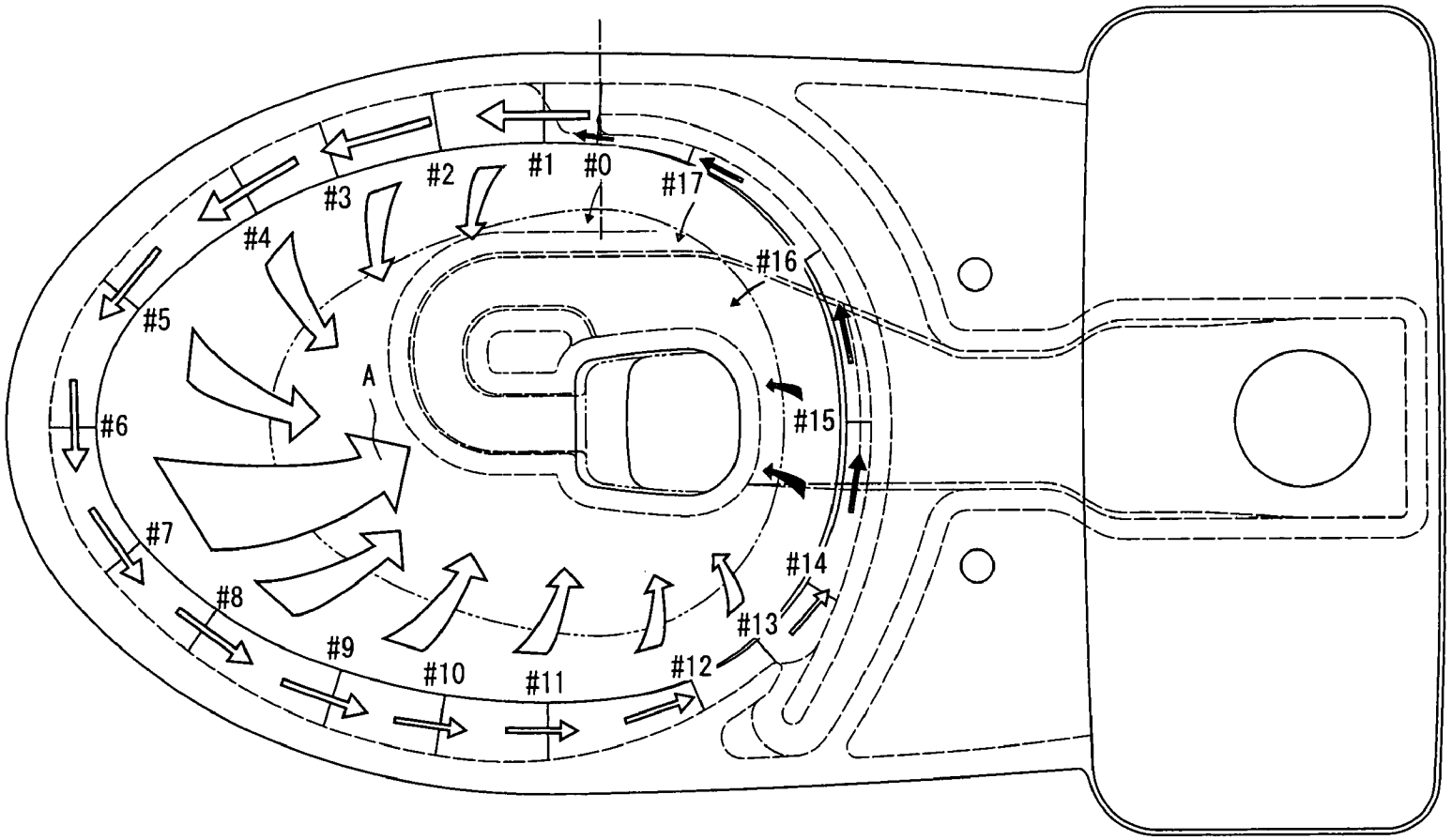
FIG. 25 is a plan view showing how the vortex flows at the locations #0-#17 in the flush toilet according to the seventh embodiment of the present invention.

FIG. 21 is a plan view indicating arbitrary locations #0-#17 on the bowl (shelf) of the flush toilet according to the seventh embodiment of the present invention (shown without the tank), FIG. 22 is a set of drawings in which (a) to (f) are sectional views of portions of the bowl including the shelf taken at some of the arbitrary locations, FIG. 23 is a graph showing the width of the shelf (shelf width) at the locations #0-#17 in the flush toilet according to the seventh embodiment of the present invention, FIG. 24 is a graph showing the radius of curvature of the curved surface between the shelf and waste receiving surface at the locations #0-#17 in the flush toilet according to the seventh embodiment of the present invention, and FIG. 25 is a plan view showing how the vortex flows at the locations #0-#17 in the flush toilet according to the seventh embodiment of the present invention.

In FIG. 21, locations on the shelf 6*c* are indicated by #0-#17. The spacing between the locations is arbitrary. The location of the first water spout 11 is designated #0 (=#18), the location of the second water spout 12 is designated #13, the location of the front end of the bowl is designated #6, and the location at the rear end of the bowl is designated 15#.

The locations where the first and second water spouts 11, 12 are disposed will be explained with reference to FIG. 21 before going into an explanation of the shape of the shelf. The bowl 2 (shelf 6*c*) is substantially elliptical and thus laterally symmetrical as viewed from the front. On the whole, moreover, the radius of curvature is relatively large at the #17-#4 region and the #8-#12 region and relatively small at the #4-#8 region and the #12-#17 region.

Viewing the locations of the first and second water spouts 11, 12 in relation to the radius of curvature of the bowl 2, it can be seen that the first water spout 11 is positioned on one side of the bowl relative to its fore-aft direction (left side as viewed from the front in FIG. 21) at a point (#0) near the point (#'17) where the radius of curvature of the bowl changes from a smaller value to a larger value and the second water spout 12 is positioned on the other side (right side) of the bowl at a point (#13) near the point (#12) where the radius of curvature of the bowl changes from a larger value to a smaller value.

In this embodiment, the positioning of the first and second water spouts 11, 12 at these points causes the cleansing water spouted from the first water spout 11 to cleanse the region of large radius of curvature (#0-#4) on one side (left side) of the bowl, the region of small radius of curvature (#4-#8) at the front end and the region of large radius of curvature (#8-#12) on the other side (right side) and causes the cleansing water spouted from the second water spout 12 to cleanse the remaining region of larger radius of curvature (#13-#0) region at the rear end. The flush toilet according to this embodiment can therefore achieve efficient cleansing of the all regions of the bowl.

The width of the shelf (shelf width W) will now be explained with reference to FIGS. 21 to 23. In this embodiment, for the purpose of ensuring cleansing of the whole bowl surface, a further measure is adopted of varying the shelf width W of the shelf 6*c* of the waste receiving surface 5 so as to make the main flow of the cleansing water spouted from the first water spout 11 (indicated by "A" in FIG. 25) flow toward the inlet 4*a* of the drainage channel 4. In other words, the shelf width W is varied so as to be wider at the regions on the opposite sides (left and right sides) relative to the fore-aft center axis of the bowl and to be narrower at the front end region of the bowl. The narrowing of the shelf width in this manner increases the amount of cleansing water that flows from the shelf into the bowl (onto the waste receiving surface 5), while the broadening thereof impedes flow of cleansing water into the bowl, whereby it continues to flow downstream as a vortex.

Specifically, as shown in FIGS. 22 and 23, the shelf width W0 at #0 is 30 mm, the shelf width W4 at #4 is 26 mm, the shelf width W6 at #6 is 22 mm, the shelf width W11 at #11 is 27 mm, the shelf width W12 at #12 is 16 mm, the shelf width W15 at #15 is 15 mm, and the shelf width W18 at #18 is 5 mm, Overall, as shown in FIG. 23, the shelf width W is wider in the region of larger radius of curvature (#0-#3) downstream of the first water spout 11, becomes progressively narrower in the region of smaller radius of curvature with increasing proximity to the front end (#6) location, and is narrowest in the neighborhood of the front end (#5-#7). It then grows larger in the downstream direction to become wider in the region of larger radius of curvature (#9-#11), whereafter it rapidly becomes narrower just before the second water spout 12. In the region downstream of the second water spout 12 (#13-#18), the shelf width W rapidly narrows. Thus in this embodiment the shelf width is made narrow immediately upstream of the second water spout 12 and made narrow immediately upstream of the first water spout 11, whereby splashing of water (shooting of cleansing water almost straight upward) owing to collision of water from upstream with the water spouted from the respective water spouts is reliably prevented.

Further, as shown in FIG. 22 to 24, in this embodiment the width of the shelf is defined at an appropriate value and, further, the radius of curvature R of the curved surface between the shelf 6*c* and waste receiving surface 5 is varied along the shelf in order to control the flow of cleansing water including the vortex. Specifically, as shown in FIG. 24, the radius of curvature R of the curved surface between the shelf and the waste receiving surface increases downstream of the location (#0) of the first water spout 11, becomes maximum in the region (#6-#11) downstream of front end of the bowl, and then decreases in the further downstream region.

In the present embodiment, the radius of curvature R of the curved surface between the shelf and waste receiving surface is thus given a larger value in the region (#6-#11) downstream of the front end of the bowl than at other regions. Thus the region having a downward slope of greater than 15 degrees and narrower shelf width is expanded so that the whole surface of the bowl can be reliably cleansed because cleansing water more readily flows from the shelf into the bowl (onto the waste receiving surface) in this region. In addition, the main flow A of the cleansing water spouted from the first water spout 11 is made to flow readily toward the inlet 4*a* of the drainage channel 4.

It should be noted that the region between the shelf 6*c* and waste receiving surface 5 need not be formed as a curved surface and this interconnection region can instead be formed as a plane surface.

Figure 27:
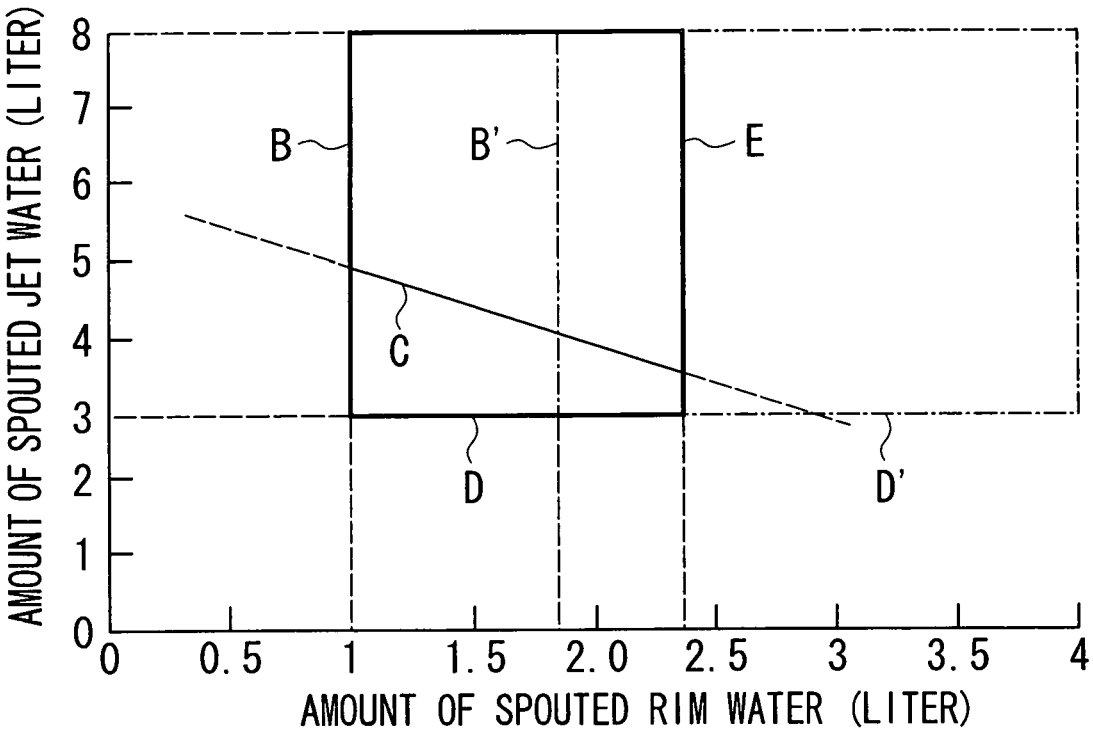
FIG. 27 is a graph showing ranges of the amounts of rim water and jet water in the flush toilet equipped with a cleansing water tank according to the present invention.

The aforesaid flush toilet equipped with a cleansing water tank that is an embodiment of the present invention will now be explained with reference to FIGS. 26 and 27 regarding, inter alia, the amount of rim water (R1) spouted from the first water spout 11, the amount of rim water (R2) spouted from the second water spout 12, the amount of jet water (Z) spouted from the jet hole 8, and the allocation of the total amount of spouted water between rim water R (=R1+R2) and jet water Z. FIG. 26 is a table setting out the cleansing limit A, conveyance limit B, performance limit D etc. of a flush toilet equipped with a cleansing water tank that is an embodiment of the present invention. FIG. 27 is a graph showing ranges of the amounts of rim water and jet water in the flush toilet equipped with a cleansing water tank according to the present invention.

FIGS. 26 and 27 are based on data (test results) obtained when standing water was present in the bowl and flushing was conducted using only cleansing water stored in the cleansing water tank.

Flush toilets in general have a cleansing limit A, conveyance limit B and performance limit D, and a flush toilet utilizing a vortex additionally has a water splashing limit E. All of the limit values need to be satisfied.

These limit values will be explained by comparing them between the flush toilet according to this embodiment (tank capacity of 6 liters) and a prior art flush toilet (type that spouts water from numerous holes formed in a box rim; tank capacity of 6 liters).

The cleansing limit A is the limit value of the amount of rim cleansing water enabling washing once around the bowl. In other words, it is the lower limit of the amount of spouted rim water capable of wetting the whole bowl surface with the rim cleansing water. As shown in FIG. 26, the cleansing limit A was 1.3 liters in the prior art flush toilet, while it was 0.5 liters (=R1+R2) in the flush toilet according to this embodiment, meaning that the flush toilet of this embodiment required less spouted rim water.

The conveyance limit B is the lower limit value of the amount of spouted rim water enabling the rim cleansing water to convey substitute waste dropped into the bowl to the drainage channel (trap). More specifically, it is the lower limit value of the amount of spouted rim water enabling the rim cleansing water to move 40 g of substitute waste dropped on the waste receiving surface to the standing water region.

The substitute waste resembled the stool of a person in a normal state of health. It was prepared by adjusting the hardness and shape of solid matter consisting of an organic component and an ash component and having the water content of 80% or greater considered normal for a stool.

As shown in FIG. 26, the conveyance limit B was 1.8 liters in the prior art flush toilet, while it was 1.0 liter (=R1+R2) in the flush toilet according to this embodiment, meaning that the flush toilet of this embodiment required less spouted rim water.

The performance limit D is the lower limit value of the amount of spouted jet water capable of properly discharging the substitute waste. As shown in FIG. 26, the performance limit D was 3.0 liters in both this embodiment and the prior art.

The water splashing limit E is the upper limit value of the amount of spouted rim water below which substantially horizontal splash-out of cleansing water from the rim (particularly splash-out of cleansing water from the front of the toilet) does not occur. Water splash-out was a matter of concern only in the vortex-type flush toilet according of the embodiment because it does not occur in a flush toilet which, like the prior art flush toilet, spouts water from numerous holes provided in a box rim. As shown in FIG. 26, the splash-out limit value was determined separately for the individual amounts of spouted rim water and in the flush toilet according to this embodiment was found to be 2.3 liters (amount of spouted rim water R1 from the first water spout 11).

The flush toilet according to this embodiment, denoted Embodiment (C) in FIG. 26, is shown to have an amount of spouted rim water R (=R1+R2) of 2.0 liters and an amount of spouted jet water Z of 4.0 liters. This flush toilet satisfies all of the limits, namely cleansing limit A, conveyance limit B, performance limit D and water splashing limit E.

FIG. 27 is a graph showing how the amount of spouted rim water and the amount of spouted jet water are related to the conveyance limit B, performance limit D and water splashing limit E.

As shown in FIG. 27, in the prior art flush toilet, the amount of spouted jet water is greater than the performance limit D' of 3.0 liters and the amount of spouted rim water R is greater than the conveyance limit B' of 1.8 liters. On the other hand, in the flush toilet of this embodiment, the amount of spouted jet water is greater than the performance limit D or 3.0 liters and the amount of spouted rim water R (=R1+R2) is greater than the conveyance limit B of 1.0 liter. Further, the amount of spouted rim water R1 (and R2) is less than the water splashing limit E of 2.3 liters. FIG. 27 further shows the amount of spouted rim water R and the amount of spouted jet water Z of which the embodiment C having a tank capacity of 6 liters is capable.

As explained in the foregoing, the flush toilet according to this embodiment reduces the conveyance limit B from the conventional 1.8 liters to 1.0 liters, thereby realizing a proportional conservation of cleansing water and enabling use of a water-conserving tank (tank capacity of 4 to 6 liters). In addition, the amount of spouted jet water can be increased for a tank of the same capacity (e.g., 6 liters), so that it becomes possible to produce a siphoning action that much earlier and thus achieve effective cleansing and discharge of waste.

In the flush toilet according to this embodiment, the allocation (ratio) of cleansing water between the amount of spouted rim water R and the amount of spouted jet water Z in the case of tank capacity of 6 liters is, as shown in FIG. 26, set in the range of (17%:83%) to (50%:50%) so as to satisfy both the conveyance limit B and the performance limit D.

Moreover, as regards the amount of spouted rim water R in the flush toilet according to this embodiment, the amount of rim water R1 spouted from the first water spout 11 is made greater than the amount of rim water R2 spouted from the second water spout 12 by making the opening of the first water spout 11 larger. The allocation (ratio) of the amounts of spouted rim water R1 and R2 is set substantially in proportion to the distance traveled by the vortex between each water spout and the other.

In the flush toilet according to this embodiment, the first water spout 11 and second water spout 12 are situated at the aforesaid preferable locations, so that the amount of spouted rim water R is preferably divided between the amount of rim water R1 and the amount of rim water R2 at a rate in the range of (55%:45%) to (70%:30%).

Figure 28:
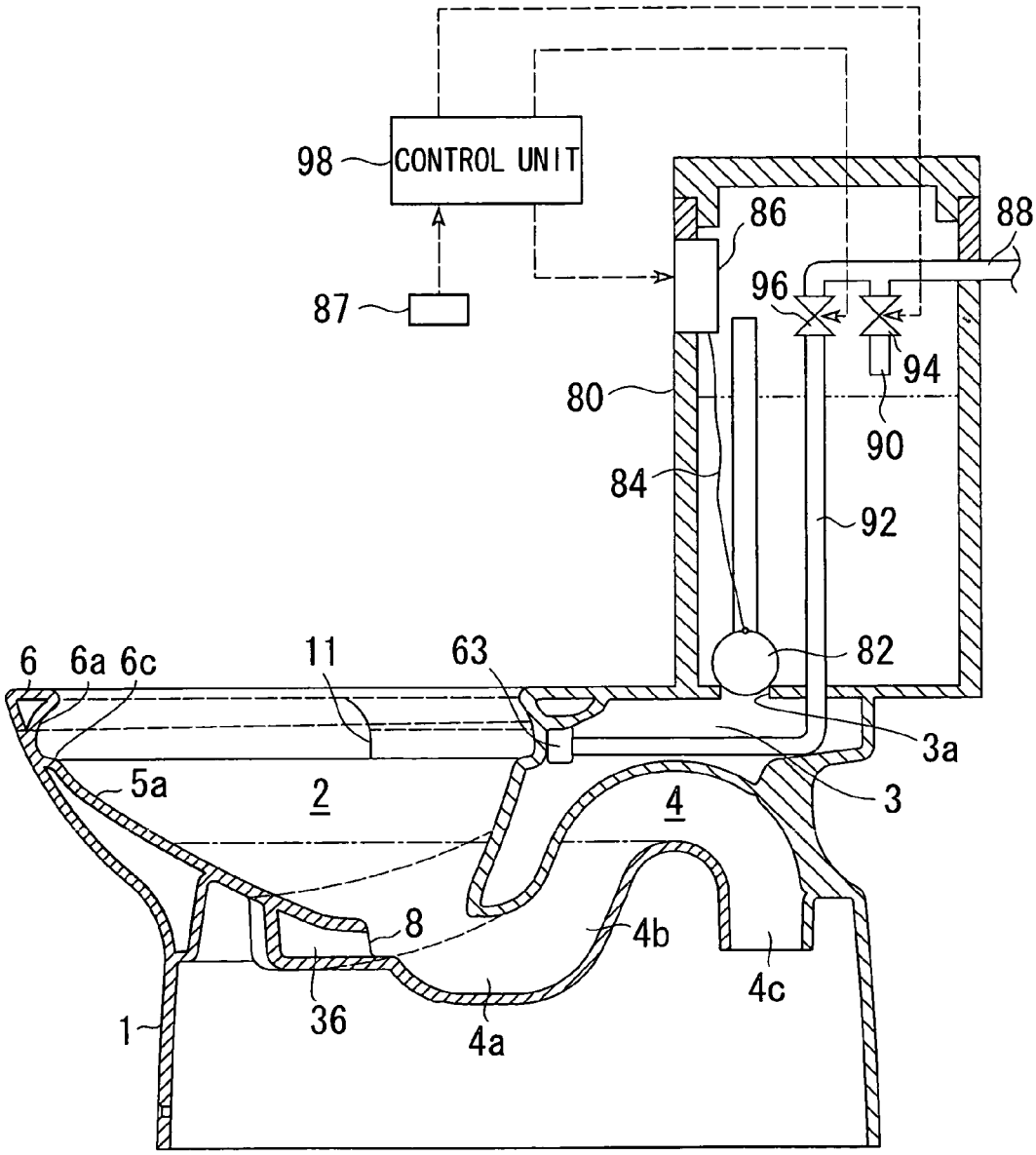
FIG. 28 a vertical sectional view showing a hybrid flush toilet that is an eighth embodiment of the present invention.

An eighth embodiment of the present invention will now be explained with reference to FIG. 28. FIG. 28 a vertical sectional view showing a hybrid flush toilet that is an eighth embodiment of the present invention.

The basic structure of the flush toilet according to the eighth embodiment is the same as that of the flush toilet according to the seventh embodiment explained above but differs therefrom in that the first and second water spouts are supplied with cleansing water from a service water pipe while the jet hole is supplied with cleansing water from a cleansing water tank. A specific explanation of these points will now be set out.

As shown in FIG. 28, the flush toilet of this embodiment is equipped with a cleansing water tank 80. The first water spout 11 and second water spout 12 are supplied with cleansing water from a service water pipe and the jet hole 8 is supplied with cleansing water stored in the cleansing water tank 80.

The bottom of the cleansing water tank 80 is formed with an opening 3*a* that is opened and closed by a ball-shaped drain valve 82. The drain valve 82 is connected to an electric motor 86 by a chain 84. When a flush switch 87 is operated, the motor 86 operates to raise the drain valve 82 so that cleansing water in the cleansing water tank 80 is supplied to the jet hole 8 through the water conduit 3 and the water channel 36. The drain valve 82 is connected to a float (not shown) and the opening 3*a* is kept open until the water in the cleansing water tank 80 falls below a prescribed level.

A service water pipe 88 passes into the cleansing water tank 80, where it branches into a first branch pipe 90 and a second branch pipe 92 respectively equipped with solenoid valves 94, 96. The first branch pipe 90 opens into the cleansing water tank 80 and is used to supply service water into the tank. The second branch pipe 92 is connected to the rim holes 63, 67 for supplying service water to the first and second water spouts 11, 12 directly from the service water pipe 88.

The flush toilet is also equipped with a control unit 98 that is input with a detection signal when operation of the flush switch 87 is sensed and responds thereto by outputting operation signals for opening/closing the solenoid valves 94, 96 and a drive signal to the motor 86. Specifically, when the flush switch 87 is operated following use of the toilet, the solenoid valve 96 is first opened to supply service water for use as cleansing water from the service water pipe 88 through the second branch pipe 92 to the first and second water spouts 11, 12. A few seconds later, the motor 86 is operated to raise the drain valve 82, whereby cleansing water in the cleansing water tank 80 is supplied to the jet hole 8 to produce a siphoning action and discharge waste. The water level in the cleansing water tank 80 then declines and the drain valve 82 closes the opening 3*a*, whereafter the standing water surface required to establish a water seal in the bowl is formed by cleansing water supplied from the second branch pipe 92. Then the solenoid valve 96 is closed and the solenoid valve 94 opened to refill the empty cleansing water tank 80 with cleansing water.

The solenoid valve 94 in the flush toilet shown in FIG. 28 can be replaced by a ball-tap valve that mechanically turns the flow of water from the first branch pipe 90 on and off in response to the water level in the cleansing water tank 80.

While the flush toilet according to the eighth embodiment offers basically the same effects as that of the seventh embodiment, it further enables the cleansing water tank 80 to be made more compact because, being a hybrid flush toilet, it is arranged so that only the jet hole 8 is supplied with cleansing water from the cleansing water tank 80 and the first and second water spouts 11, 12 are supplied with service water directly from the service water pipe. In addition, all of the water in the cleansing water tank is supplied to the jet hole 8 and the supply of cleansing water to the jet hole 8 is conducted after the standing water in the bowl has been made to swirl by supplying cleansing water to the first and second water spouts 11, 12. A siphoning action can therefore be reliably produced even though the amount of cleansing water in the tank is small.

Moreover, the control unit 98 provided in this embodiment is capable of controlling the timing and amount (ratio) of the rim and jet water spouted from the first and second water spouts 11, 12 and the jet hole 8. It is therefore possible to conduct the spouting of water from the jet hole 8 and the spouting of water from the first and second water spouts 11, 12 simultaneously.

Figure 29:
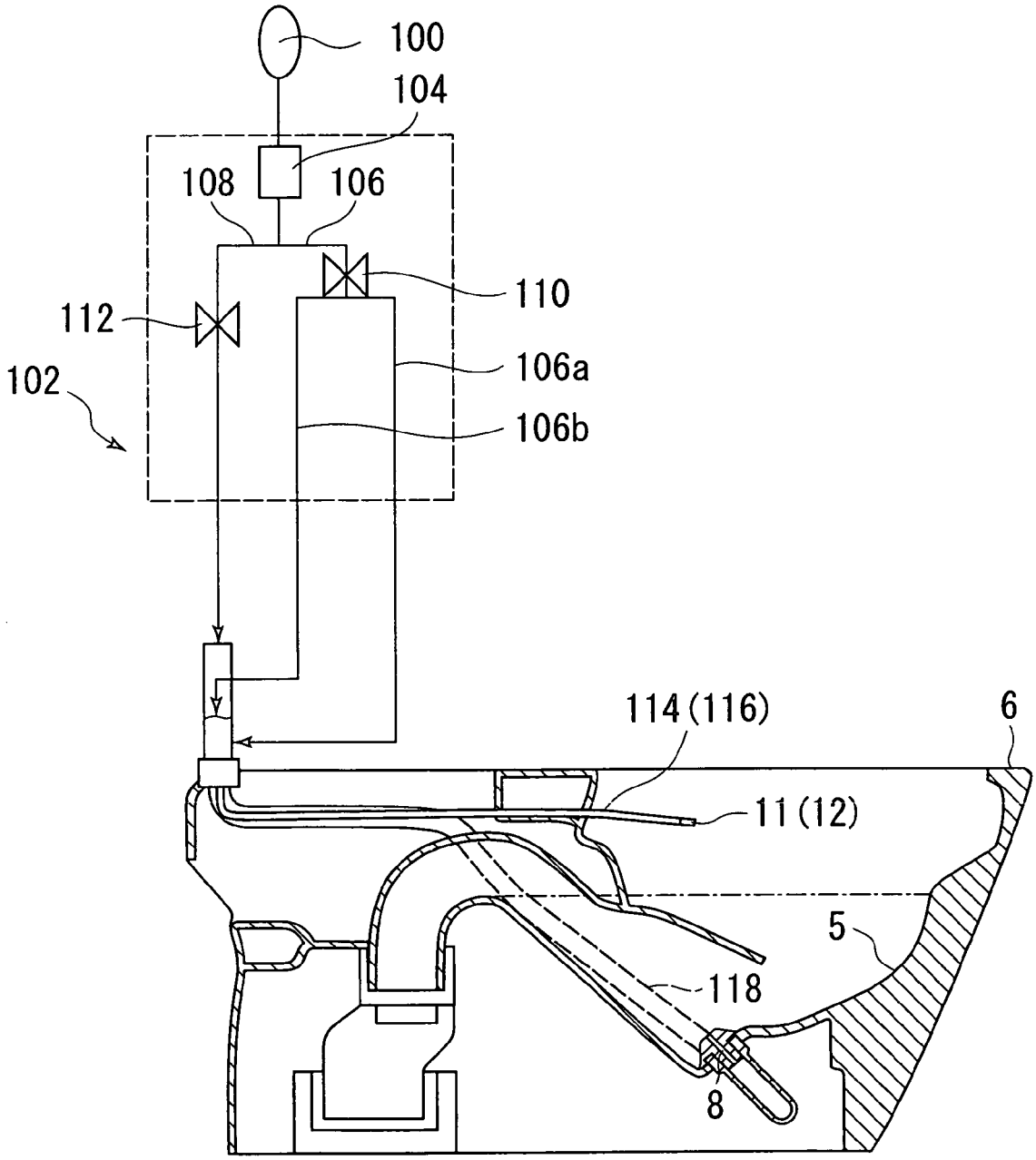
FIG. 29 is a vertical sectional view showing a direct-connection flush toilet that is a ninth embodiment of the present invention.
Figure 30:
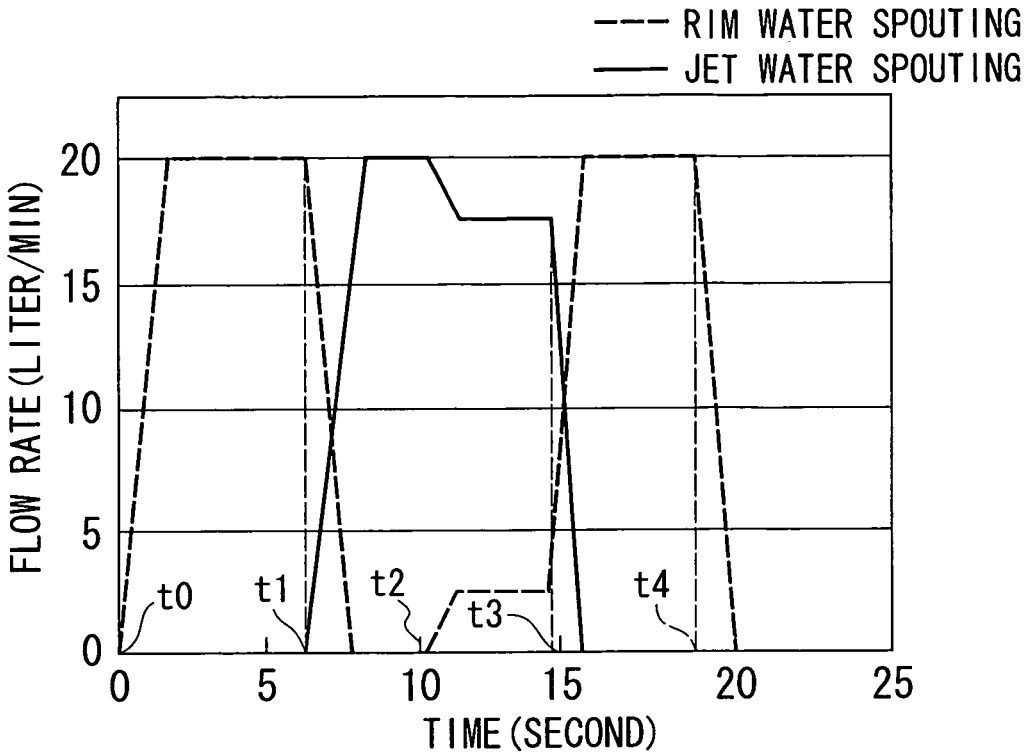
FIG. 30 is a timing chart showing the timing of rim and jet water spouting in the flush toilet according to the ninth embodiment.

A ninth embodiment of the present invention will now be explained with reference to FIGS. 29 and 30. FIG. 29 is a vertical sectional view showing a direct-connection flush toilet that is a ninth embodiment of the present invention and FIG. 30 is a timing chart showing the timing of rim and jet water spouting in the flush toilet according to the ninth embodiment.

The basic structure of the flush toilet according to the ninth embodiment is the same as that of the flush toilet according to the seventh embodiment explained above but differs therefrom in that the first and second water spouts and the jet hole are both supplied with cleansing water from a service water pipe. A specific explanation of this point will now be set out.

As shown in FIG. 29, the direct-connection flush toilet according to this embodiment is equipped with a cleansing water control unit 102 for supplying cleansing water to the toilet from a service water pipe 100. The cleansing water control unit 102 is installed at the point of connection to a service water pipe 100 and is equipped with a constant flow valve 104 for canceling feed water pressure fluctuations to maintain a constant flow rate. The constant flow valve 104 maintains the flow rate of cleansing water supplied to the first and second water spouts 11, 12 and jet hole 8 at a prescribed constant flow level at all times.

The downstream side of the constant flow valve 104 in the cleansing water control unit 102 branches into a rim pipe 106 and a jet pipe 108, which are provided with solenoid valves 110, 112 for opening and closing the respective flow paths. The opening and closing times of the solenoid valves 110, 112 can be controlled.

The downstream side of the rim pipe 106 branches into a first rim pipe 106*a* and a second rim pipe 106*b*. The first rim pipe 106*a* supplies cleansing water to the first water spout 11 through a first rim water channel 114 formed by a pipe provided inside the main toilet unit. The second rim pipe 106*b* supplies cleansing water to the second water spout 12 through a second rim water channel 116 formed by another pipe provided inside the main toilet unit.

The jet pipe 108 supplies cleansing water to the jet hole 8 through a jet water channel 118 formed by still another pipe provided inside the main toilet unit.

A flush switch (not show) is also provided.

The particulars of the timing of the spouting of rim and jet water by the cleansing water control unit of the flush toilet according to the ninth embodiment will now be explained.

In FIG. 30, the solid line indicates the flow rate of spouted rim water regulated by opening and closing of the solenoid valve 110 of the rim pipe 106, and the dashed line indicates the flow rate of spouted jet water regulated by opening and closing the solenoid valve 112 of the jet pipe 108.

As shown in FIG. 30, when a water supply command is issued by the flush switch, the solenoid valve 110 of the rim pipe 106 is opened at time t0 to spout water from the first and second water spouts 11, 12 at a prescribed flow rate. This state is maintained for a prescribed time period required to move waste present in the bowl 2 down into the standing water and also set the standing water into swirling motion. Then, at time t1, the solenoid valve 110 is closed and the solenoid valve 112 of the jet pipe 108 is simultaneously opened to spout water from the jet hole 8 at a prescribed flow rate. The spouting of water from the jet hole 8 produces a siphoning action that discharges the waste. When the spouting of water from the jet hole 8 has been continued for a certain period (up to time t2), the opening of the solenoid valve 112 is reduced slightly to make the flow rate smaller than the prescribed flow rate and the solenoid valve 110 is opened slightly to use the amount of cut back flow rate for supplying rim water. Then at time t3 after elapse of a prescribed time period, the solenoid valve 112 is closed and the solenoid valve 110 fully opened to restart spouting of water from the first and second water spouts 11, 12. At time t4 after spouting of rim water at the prescribed flow rate has been continued for a prescribed time period (for supplying water to the bowl), the solenoid valve 110 is closed to terminate the sequence of cleansing operations.

The aforesaid control of rim and jet water spouting in the flush toilet according to the ninth embodiment is designed to start spouting of water from the first and second water spouts 11, 12 immediately before terminating the spouting of water from the jet hole 8 (at time t3) so as to establish an overlap, and the waste etc. that was resting on the waste receiving surface at the start of water spouting from the jet hole 8 is flushed by water spouted from the first and second water spouts 11, 12 to be discharged outside the toilet by a siphoning action.

However, the ninth embodiment is not limited to this water spouting pattern. For instance, it is possible to adopt a spouting pattern that does not establish an overlap between rim water spouting and jet water spouting but merely follows the pattern of: Water supply from the rim pipe 106→Water supply from the jet pipe 108→Water supply from the rim pipe 106. It is also possible to conduct the spouting of water from the jet hole 8 and from the first and second water spouts 11, 12 simultaneously.

The flush toilet according to the ninth embodiment offers similar effects to those of the seventh and eighth embodiments. Moreover, owing to the fact that it is a direct-connection flush toilet, it does not require a cleansing water tank and therefore enables provision of flush toilet having a compact appearance. In addition, the timing of rim water spouting and jet water spouting can be freely set to control the supply of water for optimum flushing efficiency. Still another advantage is that the provision of two rim water spouts enables reliable flushing to be achieved even when the service water pressure is low.

Figure 31:
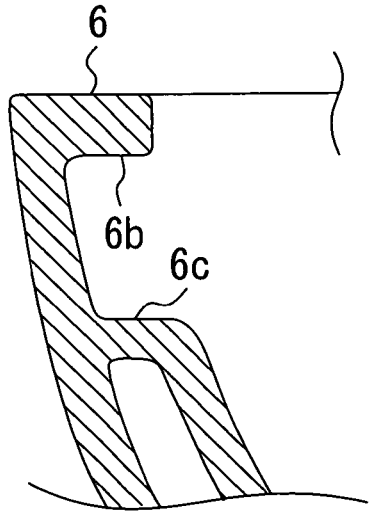
FIG. 31 is a partial sectional view showing another example of the rim in the flush toilets according to the embodiments of the present invention.

FIG. 31 is a partial sectional view showing another example of the rim in the flush toilets according to the embodiments of the present invention set out in the foregoing. As shown in FIG. 2 and other drawings, in the flush toilets according to the embodiments explained in the foregoing, the rim 6 is made to overhang by sloping the inner surface 6*a* of the rim 6 inward. However, the flush toilets of the first to ninth embodiments are not limited to this configuration and, as shown in FIG. 31, the rim 6 can instead be made to overhang by extending the undersurface 6*b* of the rim 6 horizontally inward.

As explained in the foregoing, the present invention provides a flush toilet that by producing a vortex of cleansing water that extends thoroughly to reach the extremities can achieve efficient bowl cleansing and waste discharge, irrespective of whether utilizing a tank or connected directly to a service water pipe. In addition, the present invention provides a flush toilet that is excellent in both cleansing performance and waste discharge performance even when equipped with a water-conserving tank.

What is claimed is:

1. A flush toilet that uses a prescribed amount of cleansing water stored in a cleansing water tank to cleanse the toilet and discharge waste, said flush toilet comprises:

a bowl having a bowl-shaped waste receiving surface, a rim constituting an upper edge portion whose inner surface overhangs inward and a shelf formed between the rim and the waste receiving surface;

a drainage channel whose inlet is connected to the bottom of the bowl for discharging waste;

a first water channel for supplying cleansing water from the cleansing water tank, the first water channel having an end forming a first water spout for spouting cleansing water onto the shelf of the bowl to form a vortex; and a second water channel for supplying cleansing water from the cleansing water tank, the second water channel having an end forming a second water spout for spouting cleansing water onto the shelf of the bowl in the same direction as the swirling direction of the vortex, wherein the second water channel makes a substantially horizontal U-turn prior to forming the second water spout;

wherein the bowl is substantially elliptical, having laterally opposed sides and a fore and an aft end, the sides having a radius of curvature that is relatively large compared to a radius of curvature of the aft end, the first water spout is located on one side of the bowl relative to its fore-aft center axis at a location adjacent a point where a radius of curvature of the bowl changes from a smaller value to a larger value and the second water spout is located on the other side of the fore-aft center axis at a location adjacent a point where the radius of curvature of the bowl changes from a larger value to a smaller value.

2. A flush toilet according to claim 1, wherein said flush toilet further comprises a jet hole section arranged to spout water toward the inlet of the drainage channel.

3. A flush toilet according to claim 1, wherein the first water spout and the second water spout are both located adjacent to the aft end of the bowl.

4. A flush toilet according to claim 1, wherein the amount of water spouted at the rim from the first water spout is greater than the amount of water spouted at the rim from second water.

5. A flush toilet according to claim 4, wherein the amount of water spouted at the rim from the first water spout is 0.6 to 2.3 liters and the amount of amount of water spouted at the rim from the second water spout is 0.4 to 1.2 liters.

6. A flush toilet according claim 1, wherein the total amount of water spouted at the rim from the first and second water spouts is at least 1.0 liter.

7. A flush toilet according to claim 2, wherein the amount of water spouted from the jet hole section is greater than the total amount of water spouted at the rim from the first water spout and second water spout.

8. A flush toilet according to claim 7, wherein when the capacity of the cleansing water tank is 6 liters, the total amount of water spouted at the rim from the first water spout and second water spout is 1 to 3 liters and the amount of water spouted from the jet hole section is 5 to 3 liters.

9. A flush toilet according to claim 1, wherein the shelf of the bowl is formed to vary in width in a manner that causes the main stream of the cleansing water spouted the first water spouting section to flow toward the inlet of the drainage channel.

10. A flush toilet according to claim 9, wherein the width of the shelf of the bowl is formed wider at regions on opposite lateral sides of the bowl relative to its fore-aft center axis and formed narrower at the front end region of the bowl.

11. A flush toilet according to claim 1, wherein the shelf of the bowl is sloped downward, the angle of inclination being downward within the range of 0 to 15 degrees.

12. A flush toilet that uses a prescribed amount of cleansing water to cleanse the toilet and discharge waste, said flush toilet comprises:

a bowl having a bowl-shaped waste receiving surface, a rim constituting an upper edge portion whose inner surface overhangs inward and a shelf formed between the rim and the waste receiving surface;

a drainage channel whose inlet is connected to the bottom of the bowl for discharging waste;

a first water channel having an end forming a first water spout for spouting a first amount of cleansing water onto the shelf of the bowl to form a vortex, the first water channel supplying the first amount of cleansing water to the first water spout;

a second water channel having an end forming a second water spout for spouting a second amount of cleansing water onto the shelf of the bowl in the same direction as the swirling direction of the vortex, the second water channel making a substantially horizontal U-turn prior to supplying the second amount of cleansing water to the second water spout, the first amount of cleansing water being greater than the second amount of cleansing water; and a jet hole section arranged to spout water toward the inlet of the drainage channel;

wherein the bowl is substantially elliptical, having laterally opposed sides and a fore and an aft end, the sides having a radius of curvature that is relatively large compared to a radius of curvature of the aft end, the first water spout is located on one side of the bowl relative to its fore-aft center axis at a location adjacent a point where a radius of curvature of the bowl changes from a smaller value to a larger value and the second water spout is located on the other side of the fore-aft center axis at a location adjacent a point where the radius of curvature of the bowl changes from a larger value to a smaller value.

* * * * *

UNITED STATES PATENT AND TRADEMARK OFFICE

CERTIFICATE OF CORRECTION

PATENT NO. : 7,661,153 B2
APPLICATION NO. : 10/526337
DATED : February 16, 2010
INVENTOR(S) : Kenichi Nakamura et al.

It is certified that error appears in the above-identified patent and that said Letters Patent is hereby corrected as shown below:

Column 19, Line 30

After "rim from second water" insert -- spout --.

Column 20, Line 1

After "cleansing water spouted" insert -- at --.

Signed and Sealed this

Eleventh Day of May, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,661,153 B2
APPLICATION NO. : 10/526337
DATED : February 16, 2010
INVENTOR(S) : Nakamura et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 211 days.

Signed and Sealed this

Fourth Day of January, 2011

David J. Kappos

David J. Kappos
*Director of the United States Patent and Trademark Office*